US012544639B2

(12) United States Patent
Jones et al.

(10) Patent No.: US 12,544,639 B2
(45) Date of Patent: Feb. 10, 2026

(54) MINIATURE GOLF HOLE WITH SPINNING WHEEL

(71) Applicant: Puttshack LTD, London (GB)

(72) Inventors: Samuel Nicolas Jones, Scraptoft (GB); Thomas Stephen David Hopkinson, Reading (GB)

(73) Assignee: Puttshack LTD, London (GB)

( * ) Notice: Subject to any disclaimer, the term of this patent is extended or adjusted under 35 U.S.C. 154(b) by 659 days.

(21) Appl. No.: 18/082,493

(22) Filed: Dec. 15, 2022

(65) Prior Publication Data

US 2024/0198199 A1 Jun. 20, 2024

(51) Int. Cl.
*A63B 67/02* (2006.01)

(52) U.S. Cl.
CPC ..... *A63B 67/02* (2013.01); *A63B 2220/833* (2013.01)

(58) Field of Classification Search
CPC ..... A63B 67/02; A63B 57/357; A63B 57/405; A63B 69/002; A63B 63/00; A63F 7/0628; A63F 7/34; A63F 7/1472
See application file for complete search history.

(56) References Cited

U.S. PATENT DOCUMENTS 2,232,569 A 2/1941 Bernays
3,011,791 A 12/1961 Page
3,366,388 A * 1/1968 Del Raso ..... A63B 67/02 473/163
3,862,760 A * 1/1975 Davis ..... A63B 67/02 473/169
5,100,145 A * 3/1992 Kim ..... A63B 67/02 473/163
5,553,859 A 9/1996 Kelly et al.
5,573,247 A * 11/1996 Ridge ..... A63B 63/08 273/271

(Continued)

FOREIGN PATENT DOCUMENTS

JP H0847558 2/1996
KR 20120138160 12/2012

(Continued)

OTHER PUBLICATIONS

International Search Report and the Written Opinion of the International Searching Authority for PCT/GB2023/053215 dated May 5, 2024.

*Primary Examiner* — David L Lewis
(74) *Attorney, Agent, or Firm* — Neal, Gerber & Eisenberg LLP

(57) ABSTRACT

A miniature golf hole with a spinning wheel is disclosed. An example miniature golf hole includes a spinning wheel that defines cavities arranged circumferentially about the spinning wheel. A cavity surface of each of the cavities defines one or more cavity openings through which the golf ball is capable of traveling upon entering the respective cavity. The one or more cavity openings of each of the cavities are positioned at a radial distance along the spinning wheel that is different to that of the one or more cavity openings of the other of the cavities. A transfer panel is stationary and positioned below the spinning wheel. The transfer panel includes concentric rings each of which aligns vertically with the one or more cavity openings of a respective one of the cavities to receive the golf ball from the respective cavity.

20 Claims, 24 Drawing Sheets

(56) References Cited

U.S. PATENT DOCUMENTS

| | | | | |
|---|---|---|---|---|
| 9,168,444 | B2 * | 10/2015 | Overcash | A63B 67/02 |
| D1,053,951 | S * | 12/2024 | Jones | A63B 67/02<br>D21/358 |

FOREIGN PATENT DOCUMENTS

| | | |
|---|---|---|
| KR | 20140072701 | 6/2014 |
| WO | WO-2018199369 | 11/2018 |

* cited by examiner

MINIATURE GOLF HOLE WITH SPINNING WHEEL

TECHNICAL FIELD

The present disclosure generally relates to miniature golf and, more specifically, to a miniature golf hole with a spinning wheel.

BACKGROUND

Miniature golf (also referred to as "minigolf" or "putt-putt") is a game that is typically played on courses consisting of a series of holes. Each player is to putt a respective ball into each of the series of holes. Oftentimes, each hole in a miniature golf course includes one or more artificial obstacles and/or unusual geometric arrangements to make putting a ball into the hole more difficult and entertaining. Known example obstacles include ramps, tubes, curved or angled walls, windmills, etc.

Miniature golf has been ubiquitous for across many continents for generations. In turn, many people are familiar with the more common configurations and obstacles associated with miniature golf courses. Additionally, many experienced golf players play a round of miniature golf from time-to-time. These experienced golf players may have developed skills that help them more easily maneuver around and/or through obstacles and configurations of miniature golf holes. Some less experienced players may become frustrated when competing against more experienced players. In turn, many operators of miniature golf facilities have sought new ways to engage, challenge, and entertain miniature golf players of all skill levels.

SUMMARY

The appended claims define this application. The present document discloses aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown for a miniature golf hole with a spinning wheel. An example miniature golf hole includes a tee surface on which a golf ball is set for an initial stroke, a hole surface, one or more putting cups positioned along the hole surface, and a spinning wheel that defines cavities arranged circumferentially about the spinning wheel in a side-by-side manner. Each of the cavities is partially defined by a respective cavity surface along which the golf ball is capable of traveling upon entering the respective cavity. The cavity surface of each of the cavities defines one or more cavity openings through which the golf ball is capable of traveling upon entering the respective cavity. The one or more cavity openings of each of the cavities are positioned at a radial distance along the spinning wheel that is different to that of the one or more cavity openings of the other of the cavities. The miniature golf hole also includes a ramp positioned between the tee surface and the spinning wheel to direct the golf ball onto the spinning wheel. The miniature golf hole also includes a transfer panel that is stationary and positioned below the spinning wheel. The transfer panel includes concentric rings each of which aligns vertically with the one or more cavity openings of a respective one of the cavities to receive the golf ball from the respective cavity. The miniature golf hole also includes sensors configured to detect through which of the cavities the golf ball has traveled and a first channel configured to transfer the golf ball from the transfer panel and onto the hole surface.

In some examples, each of the spinning wheel and the transfer panel is positioned in a non-vertical and non-horizontal orientation. In some such examples, the spinning wheel includes radial walls that separate the cavities from each other. The radial walls are arranged in a spoke formation such that each of the cavities is substantially wedged-shaped. Further, in some such examples, each of the radial walls defines a portion of an upper surface of the spinning wheel. The spinning wheel defines a center opening at a center axis of the spinning wheel. The spinning wheel is configured such that the golf ball is capable of traveling onto the upper surface, along one of the radial walls, and into the center opening. Some such examples further include a second channel configured to transfer the golf ball from the center opening and into one of the one or more putting cups.

Some examples further include a sensor assembly that includes the sensors and is positioned below the transfer panel. Each of the sensors is positioned adjacent a respective one of the concentric rings of the transfer panel such that the sensors are configured to detect through which of the cavities the golf ball has traveled.

An example assembly for a rotating surface of a miniature golf hole includes a spinning wheel that defines recessed cavities arranged circumferentially about the spinning wheel in a side-by-side manner. Each of the recessed cavities is partially defined by a respective recessed surface along which a golf ball is capable of traveling upon entering the respective recessed cavity. The recessed surface of each of the recessed cavities defines one or more recessed openings through which the golf ball is capable of traveling upon entering the respective recessed cavity. The one or more recessed openings of each of the recessed cavities are positioned at a radial distance along the spinning wheel that is different to that of the one or more recessed openings of the other of the recessed cavities. The assembly also includes a motor configured to drive rotation of the spinning wheel and a transfer panel that is stationary and positioned below the spinning wheel. The transfer panel includes concentric rings each of which aligns vertically with the one or more recessed openings of a respective one of the recessed cavities to receive the golf ball from the respective recessed cavity. The assembly also includes sensors configured to detect through which of the recessed cavities the golf ball has traveled and a first channel configured to transfer the golf ball from the transfer panel and onto a putting surface.

In some examples, for each of one or more of the recessed cavities, the spinning wheel includes one or more sloped inserts that are positioned along the recessed surface to guide the golf ball into one of the one or more recessed openings as the spinning wheel rotates.

In some examples, the spinning wheel includes radial walls that separate the recessed cavities from each other. The radial walls are arranged in a spoke formation such that each of the recessed cavities is substantially wedged-shaped. In some such examples, each of the radial walls defines a portion of an upper surface of the spinning wheel. The spinning wheel defines a center opening at a center axis of the spinning wheel. The spinning wheel is configured such that the golf ball is capable of traveling onto the upper surface, along one of the radial walls, and into the center opening.

In some examples, the transfer panel is positioned in a non-horizontal and non-vertical orientation. Each of the concentric rings defines a ring opening through which the golf ball is capable of traveling to the first channel. Some such examples further include a sensor assembly that includes the sensors, defines sensor openings for the golf ball, and is positioned below the transfer panel. Each of the sensors is positioned adjacent to a respective one of the transfer openings. The first channel is positioned below each of the sensor openings to receive the golf ball. Further, in some such examples, each of the concentric rings is aligned vertically with a respective one of the recessed cavities and each of the sensor openings is aligned vertically with a respective one of the recessed cavities such that that the sensors are configured to detect through which of the recessed cavities the golf ball has traveled. Further, some such examples further include a housing to which the sensor assembly is fixed such that none of the sensors are positioned on the spinning wheel.

In some examples, for each of the recessed cavities, the one or more recessed openings includes a set of holes positioned on opposing sides of the respective recessed cavity.

In some examples, each of the recessed cavities is defined by the respective recessed surface, a respective inner-radial surface, a respective outer-radial surface, and respective opposing side surfaces of the spinning wheel.

In some such examples, the recessed cavities include a first recessed cavity with the one or more recessed openings positioned along the outer-radial surface of the first recessed cavity.

In some such examples, the recessed cavities include a second recessed cavity with the one or more recessed openings positioned along the inner-radial surface of the second recessed cavity. The recessed surface of the second recessed cavity is a sloped surface that slopes downward from the outer-radial surface and toward the inner-radial surface to guide the golf ball into one of the one or more recessed openings as the spinning wheel rotates.

In some such examples, the recessed cavities include a third recessed cavity with the one or more recessed openings positioned radially between the inner-radial surface and the outer-radial surface of the third recessed cavity. The recessed surface of the third recessed cavity includes a sloped insert that slopes downward from the outer-radial surface and to the one or more recessed openings to guide the golf ball into one of the one or more recessed openings as the spinning wheel rotates.

In some such examples, the recessed cavities include a fourth recessed cavity with the one or more recessed openings positioned radially between the inner-radial surface and the outer-radial surface of the fourth recessed cavity. The recessed surface of the fourth recessed cavity includes sloped inserts each of which slopes downward from a respective outer-radial corner of the recessed cavity and to a respective one of the one or more recessed openings to guide the golf ball into one of the one or more recessed openings as the spinning wheel rotates.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
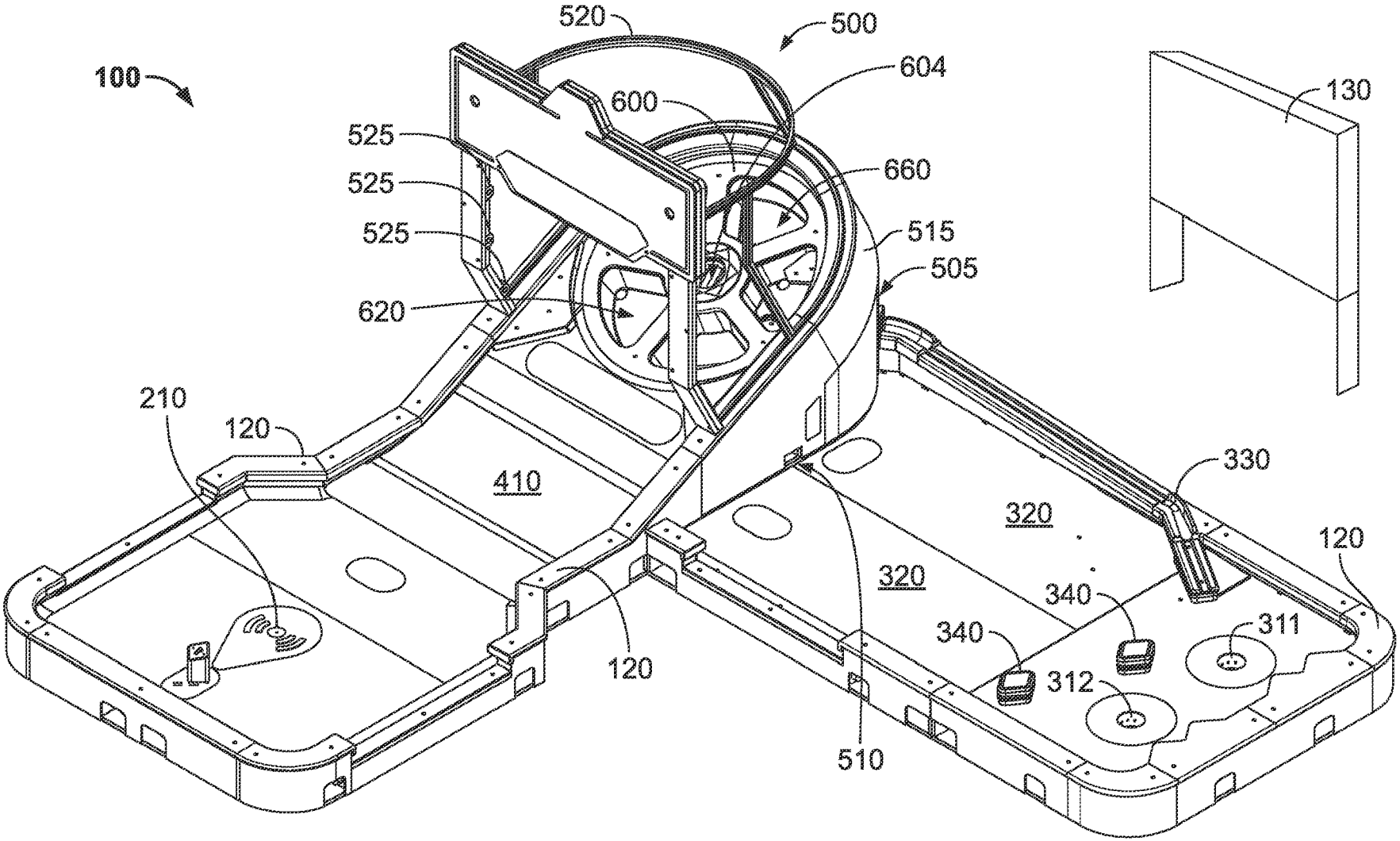
FIG. 1 illustrates an example miniature golf hole in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Example miniature golf holes disclosed herein include a spinning onto which players are to putt golf balls. The spinning nature of the wheel engages, challenges, and entertains players of all skill levels.

For example, a spinning wheel disclosed herein defines cavities (e.g., recessed cavities) arranged circumferentially about the spinning wheel in a side-by-side manner. Each of the cavities include one or more recessed openings through which the golf ball is capable of traveling. The recessed opening(s) of each of the cavities are positioned at a radial distance along the spinning wheel that is different to that of the recessed opening(s) of the other of the cavities.

In some examples, sloped inserts are positioned in respective ones of the cavities. Each of the sloped inserts includes a surface that is sloped toward the respective recessed opening(s) to guide the golf ball into one of the recessed opening(s) upon entering the respective cavity as the spinning wheel rotates. Additionally, in some examples, the spinning wheel includes a center opening at a center axis of the spinning wheel. A player may attempt to put a golf into the center opening, instead of one of the cavities, for a more difficult challenge.

A transfer panel is stationary and positioned below the spinning wheel. The transfer panel includes concentric rings each of which aligns vertically with the recessed opening(s) of a respective one of the cavities. Each of the concentric rings defines a ring opening through which the golf ball is capable of traveling. A sensor assembly includes a plurality of sensors and is positioned below the transfer panel. Each of the concentric rings is aligned vertically with a respective one of the cavities, and each of the sensors is aligned vertically with a respective one of the cavities. In turn, the sensors are configured to detect through which of the cavities the golf ball has traveled.

The rotating wheel, the transfer panel, and the sensors are arranged such that the sensors are able to detect where the golf ball has been putted onto the spinning wheel without running electrical wiring to the spinning wheel. In turn, such an arrangement prevents interfering with rotation of the spinning wheel.

Turning to the figures, FIG. 1 illustrates an example miniature golf hole 100 in accordance with the teachings herein. In the illustrated example, the miniature golf hole 100 includes a tee 210, one or more cups 311, 312 (also referred to as "putting cups, "golf cups," or "golf hole cups"), a ramp 410, and a wheel 600 (also referred to as a "spinning wheel" and a "rotating wheel"). The miniature golf hole 100 is configured such that a player is to putt a golf ball from the tee 210 and onto the ramp 410. The ramp 410 is configured to lift the golf ball onto the wheel 600, which spins while the player putts the golf ball in order to increase a level of complexity and/or uncertainty when playing on the miniature golf hole 100. In some examples, the wheel 600 spins at a constant rotational speed. In other examples, the rotational speed of the wheel 600 may fluctuate. For example, wheel 600 may spin more quickly for more experienced players and may spin less quickly for less experienced players. The golf ball, upon traveling onto and through the wheel 600, is then directed onto a hole surface 320 and/or directly into one of the cup(s) 311, 312.

Figure 2:
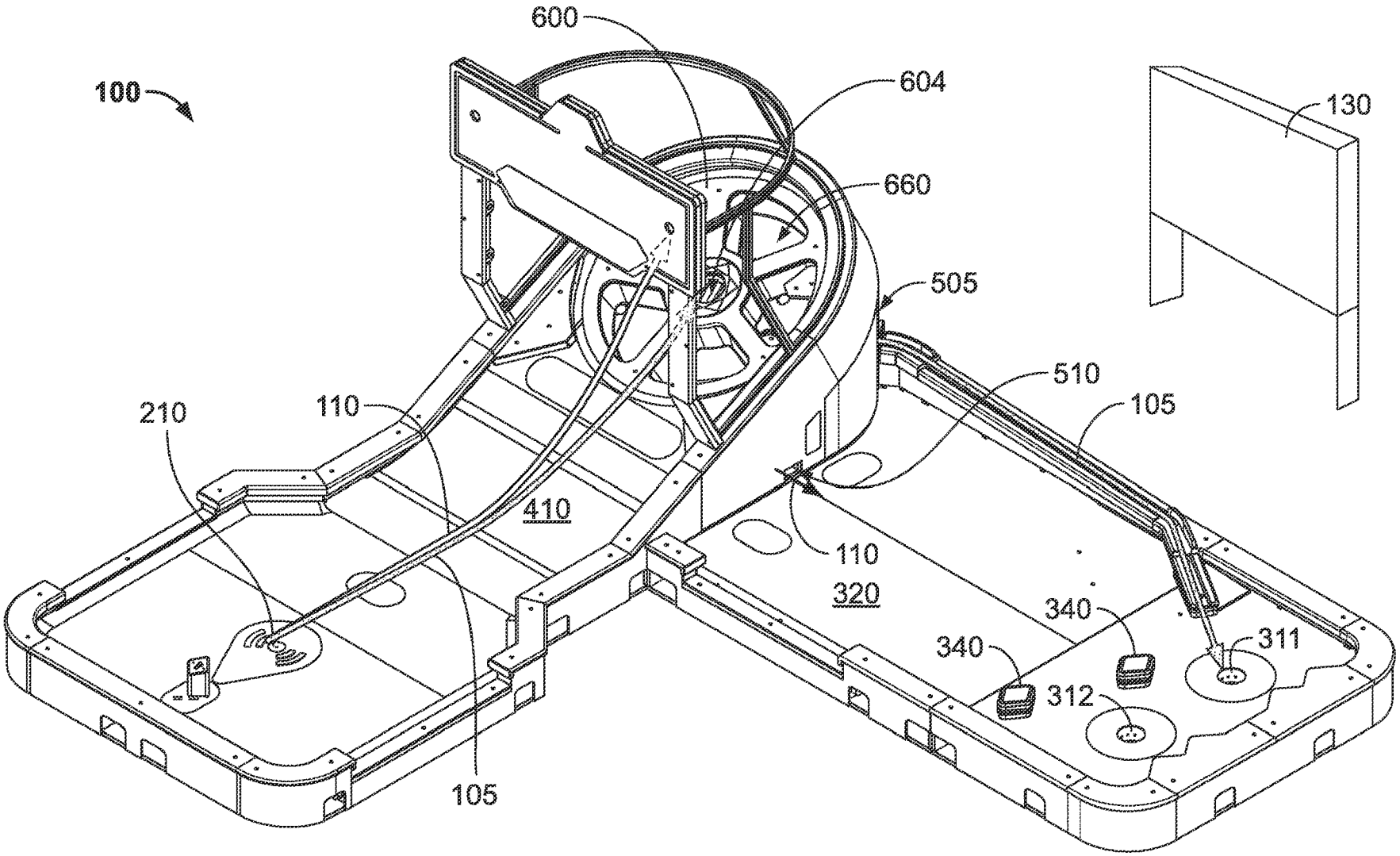
FIG. 2 depicts potential putting paths for a golf ball along the miniature golf hole of FIG. 1.

As illustrated in FIG. 2, the miniature golf hole 100 is configured to provide two potential paths 105, 110 for the golf ball. If the player putts the golf ball along the path 105 (also referred to as a "direct path"), the golf ball is sent up the ramp 410 and into a center opening 604 of the wheel 600. The golf ball is then directed to an outlet 505 and onto a track 330. The golf ball rolls down the track 330, onto the hole surface 320, and directly into the cup 311. That is, the track 330 is shaped, positioned, oriented, and/or otherwise configured to deliver the golf ball into the cup 311 without requiring another putting stroke from the player.

Otherwise, if the player putts the golf ball along the path 110 (also referred to as an "indirect path"), the golf ball is sent up the ramp 410 and into one of a plurality of cavities 620, 630, 640, 650, 660 of the wheel 600. In the illustrated example, each of the cavities 620, 630, 640, 650, 660 is a recessed cavity that is recessed from an upper surface 616 of the wheel 600. The golf ball is then directed to another outlet 510, which delivers the golf ball on the hole surface 320. Once the golf ball becomes stationary on the hole surface 320, the player may perform one or more additional putting strokes until the golf ball goes into one of the cups 311, 312. In the illustrated example, the miniature golf hole 100 includes one or more obstacles 340 located along the hole surface 320 to make it more difficult for the player to putt the golf ball into one of the 311, 312.

In some examples, electronic components are located within an interior of the golf ball. Those electronic components (e.g., an antenna, a microprocessor, memory etc.) allow the golf ball to be tracked along the miniature golf hole 100 and/or other holes of a miniature golf course. Returning to FIG. 1, the miniature golf hole 100 includes electronic components that are positioned below the tee 210. Those electronic components (e.g., an antenna, a microprocessor, memory etc.) are configured to communicate with the electronic components of the golf ball in order to detect the presence of a golf ball, detect which golf ball has been placed on the tee 210, collect information stored within memory of the golf ball, identify the player associated with the golf ball, etc. For example, a tee sensor 215 (FIG. 23) is positioned below the tee 210 to detect the presence of and/or collect information form the golf ball. In some examples, the electronic components positioned below the tee 210 are communicatively coupled to one or more processors 595 of the miniature golf hole 100 and/or a remote server associated with the miniature golf course.

Additionally, the miniature golf hole 100 of the illustrated example includes a display 130 and/or a speaker 135 (FIG. 23) that is configured to provide information to the player while playing the miniature golf hole 100. As disclosed below in greater detail, the display 130 and/or the speaker 135 is configured to present information to the player that causes the player to select which of the cups 311, 312 to target. In the illustrated example, cup sensors 313, 314 are positioned adjacent the cups 311, 312 to detect into which of the cups 311, 312 the player has putted the golf ball. For example, the cup sensor 313 is adjacent the cup 311, and the cup sensor 314 is adjacent the cup 312.

Figure 3:
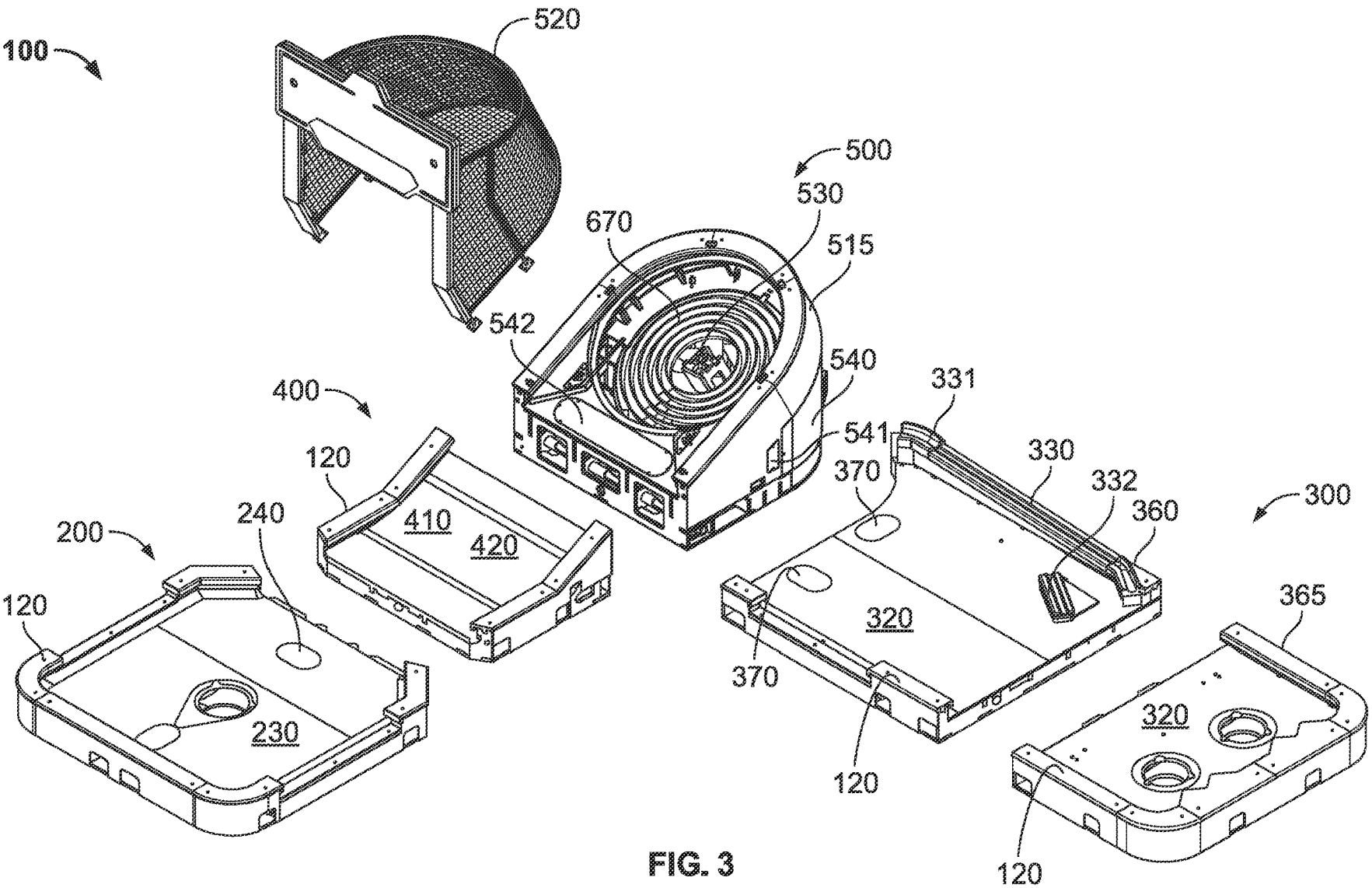
FIG. 3 is an exploded view of the miniature golf hole of FIG. 1.

The example miniature golf hole 100 is formed by connecting a plurality of segments or assemblies together. As illustrated in FIG. 3, the miniature golf hole 100 includes a tee assembly 200, a hole assembly 300, a ramp assembly 400, and a wheel assembly 500 that are securely coupled together to form the miniature golf hole 100.

Figure 4:
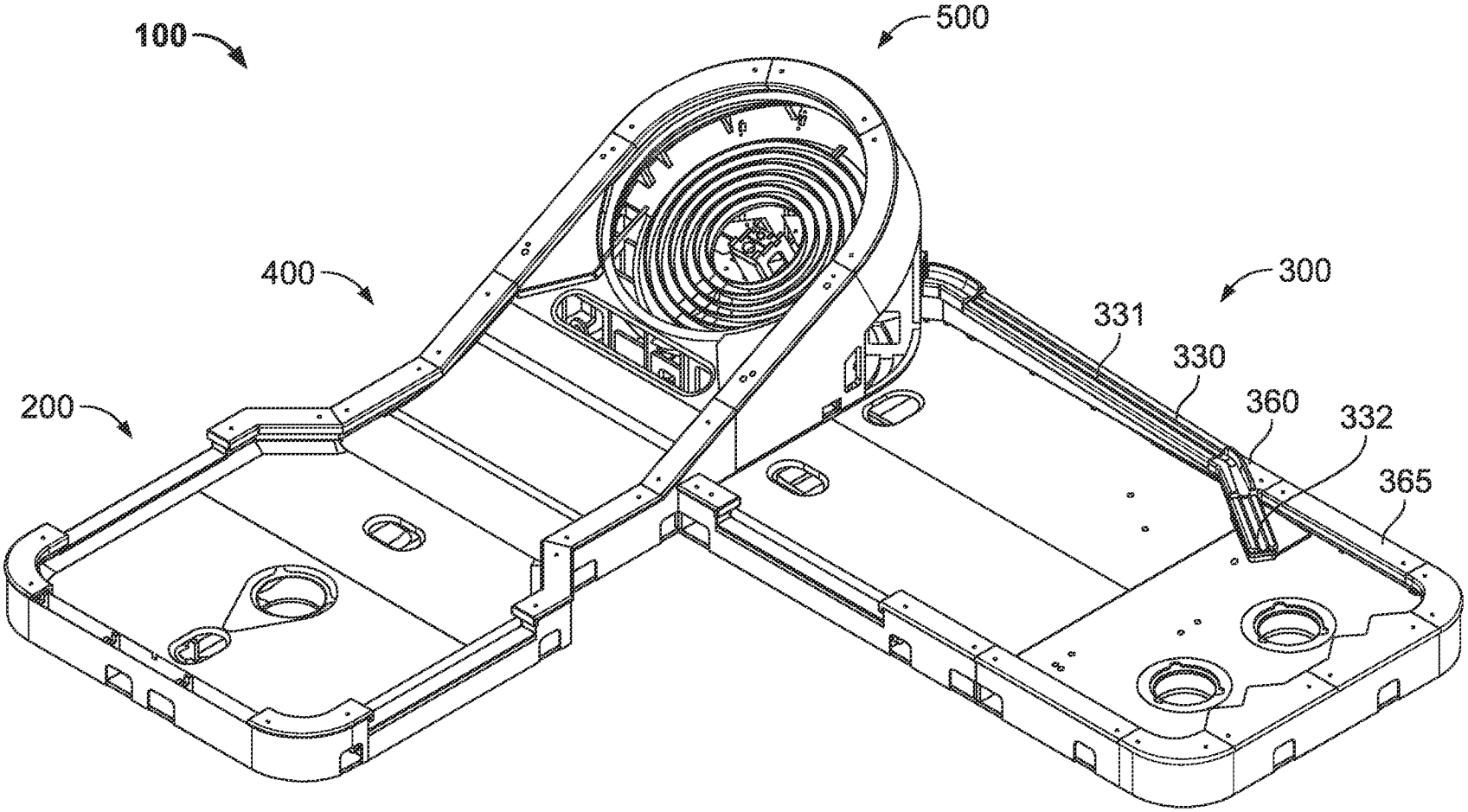
FIG. 4 illustrates depicts the miniature golf hole of FIG. 1 with some components removed to show other components more clearly.

The tee assembly 200 includes the tee 210 (not shown in FIG. 3), the tee sensor 215 (not shown in FIG. 3), a tee surface 230 along which the golf ball is to travel, and a portion of the bumper walls 120. The tee assembly 200 also includes an access panel 240 forms part of the tee surface 230. As shown in FIG. 4, the access panel 240 is removable to provide a technician with access to electrical wiring and/or other components housed below the tee surface 230. The tee 210 is removable from the tee surface 230, for example, to provide additional access to portions of the tee assembly 200 below the tee surface 230.

Returning to FIG. 3, the hole assembly 300 includes a ball-receiving segment 360 and a cup segment 365 that are coupled together to form the hole assembly 300.

The ball-receiving segment 360 includes a portion of the hole surface 320, a portion of the bumper walls 120, the track 330, and one or access panels 370. The access panels 370 form part of the hole surface 320. As shown in FIG. 4, the access panels 370 are removable to provide the technician with access to electrical wiring and/or other components housed below the hole surface 320. Returning to FIG. 3, the track 330 is formed from a fixed portion 331 and a detachable portion 332. The fixed portion 331 is fixed to and extends substantially along a portion of the bumper walls 120. As illustrated in FIG. 4, when the miniature golf hole 100 is fully assembled, a first end of the fixed portion 331 is positioned next to the outlet 505 and second end of the fixed portion 331 is positioned next to the cup segment 365. The detachable portion 332 of the track 330 is to be coupled to the second end of the fixed portion 331 and extend partially over the cup segment 365.

Returning to FIG. 3, the cup segment 365 includes the cups 311, 312 (not shown in FIG. 3), the cup sensors 313, 314 (not shown in FIG. 3), a portion of the hole surface 320, and a portion of the bumper walls 120. The cups 311, 312 are removable from the hole surface 320, for example, to provide access to portions of the cup segment 365 below the hole surface 320. The ramp assembly 400 includes a portion of the bumper walls 120, a ramp 410, and a ramp surface 420 defined by the ramp 410.

As illustrated in FIG. 1, the wheel assembly 500 includes the wheel 600 and a housing 515 in which the wheel 600 is housed. A cage 520 is coupled to an upper surface of the housing 515. The cage 520 extends around a portion of the wheel 600 (e.g., along the sides and an upper end) to prevent the golf ball from bouncing out of the playing area. The cage 520 may include one or more side panels and/or netting the keep the golf ball from leaving the playing area. The wheel assembly 500 includes one or more trip sensors 525 positioned toward a front end of the wheel assembly 500 and in front of the wheel 600. In the illustrated example, the trip sensors 525 are coupled to the cage 520. The trip sensors 525 are positioned to detect when an object other than the golf ball (e.g., a putter, an arm of a player, etc.) has entered into an area between the cage 520 and the wheel 600. For example, the trip sensors 525 are positioned above the ramp 410 to deter the trip sensors 525 from unintentionally detecting the golf ball. When one or more of the trip sensors 525 detects the presence of an object, motion of the wheel 600 is stopped.

Returning to FIG. 3, the wheel assembly 500 is depicted with the cage 520 detached from the housing 515. Additionally, the wheel 600 is removed to reveal a pillar 530 and a transfer panel 670. The wheel 600 is driven by a motor 564 (FIG. 15) to spin. The transfer panel 670 is positioned below the wheel 600. As disclosed below in further detail, the transfer panel 670 is configured to receive the golf ball from one of the cavities 620, 630, 640, 650, 660 of the wheel 600 and subsequently send the golf ball to the outlet 510.

In the illustrated example, the wheel assembly 500 includes one or more access panels 540, 541, 542 located along the housing 515. The access panels 540, 541, 542 are removable from the housing 515 to enable the technician to access the motor 564, sensors, and/or other components housed within the housing 515. For example, the access panel 540 can be detached from the housing 515 to provide access to the motor 564. In some examples, the wheel assembly 500 includes a panel sensor 543 that is configured to detect whether the access panel 540 is securely coupled to the housing 515 in a closed position. If the panel sensor 543 detects that the access panel 540 is open, the motor 564 is prevented from operating. The access panels 541, 542 can be detached can be detached from the housing 515 to provide access to smaller components, such as sensors. Additionally or alternatively, one or more of the other access panels 240, 370, 541, 542 may also include a panel sensor.

Figure 5:
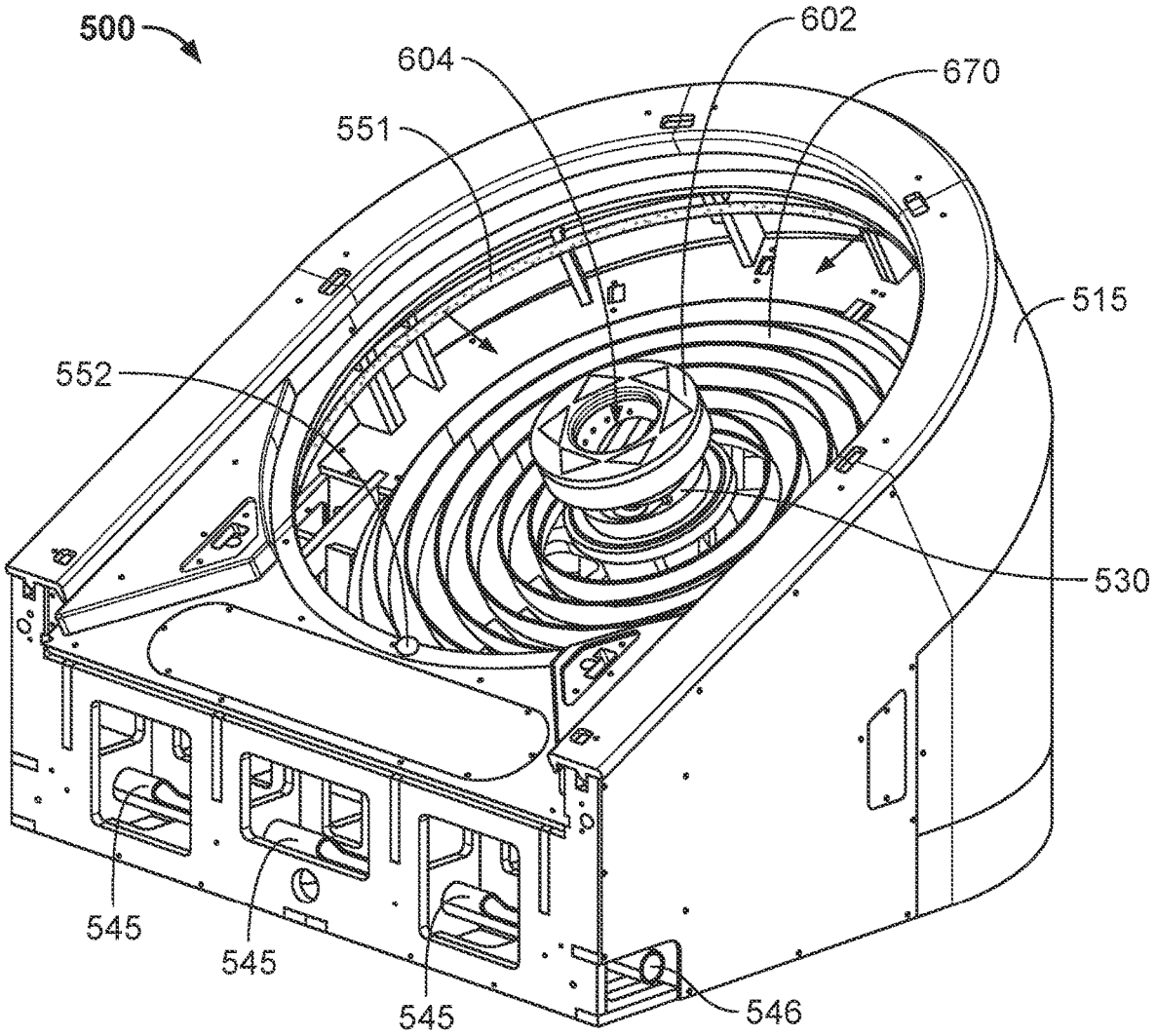
FIG. 5 illustrates a portion of a wheel assembly of the miniature golf hole of FIG. 1 with some components removed to show other components more clearly.
Figure 6:
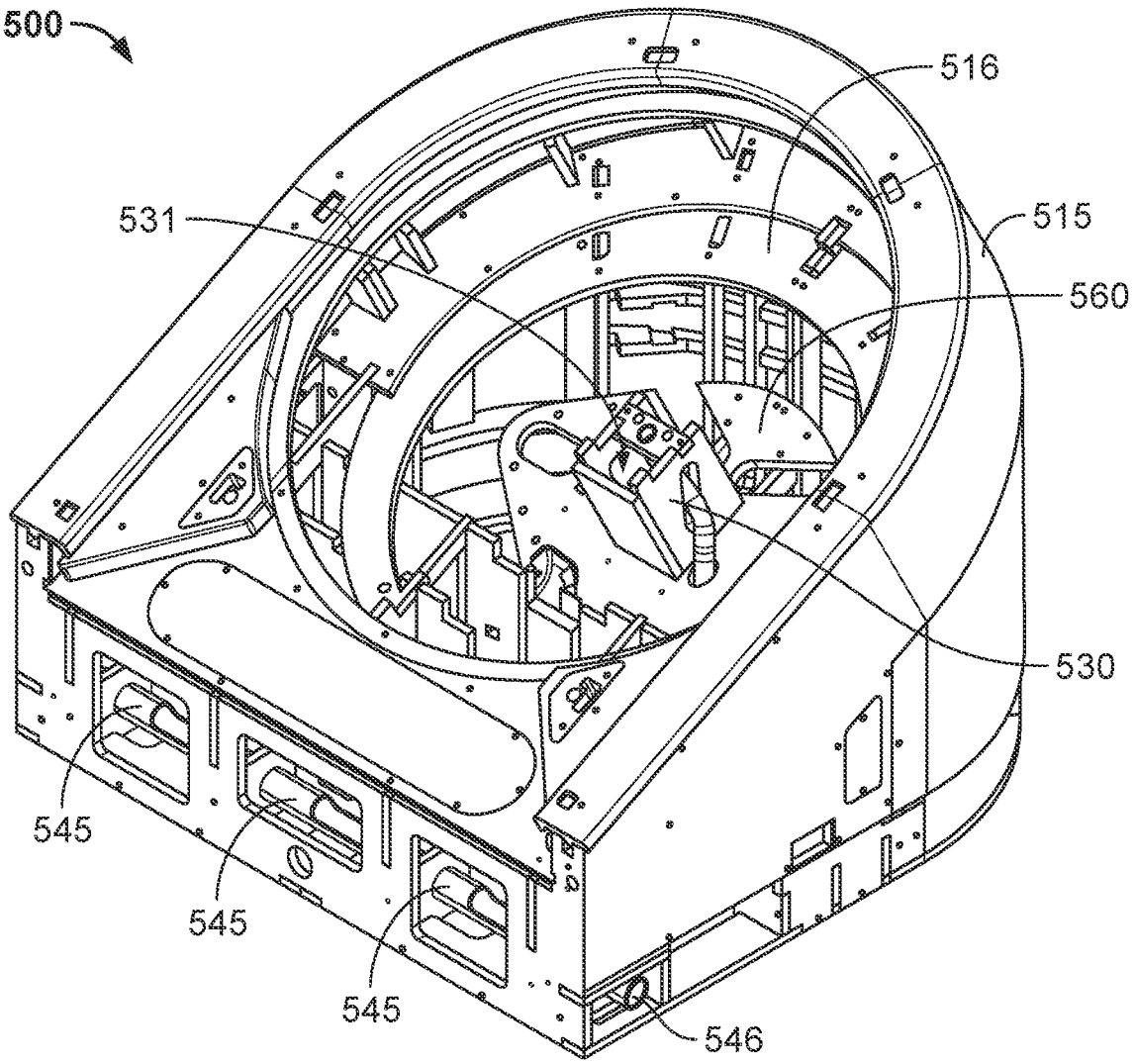
FIG. 6 illustrates depicts the wheel assembly of FIG. 5 with additional components removed to show other components more clearly.

FIGS. 5-6 further depict the wheel assembly 500 with the cage 520 and a portion of the wheel 600 removed in order to depict other components of the wheel assembly 500. As illustrated in FIGS. 5-6, the wheel assembly 500 includes one or more fasteners 545 that are positioned along a front end of the housing 515 and configured to securely connect the wheel assembly 500 to the ramp assembly 400. The wheel assembly 500 includes another fastener 546 that is positioned on a side of the housing 515 and configured to securely connect the wheel assembly 500 to the hole assembly 300.

As illustrated in FIG. 5, the pillar 530 extends upwardly and through a center opening of the transfer panel 670 such that an end of the pillar 530 extends beyond the transfer panel 670. A center cap 602 of the wheel 600 is coupled to the end of the pillar 530 above the transfer panel 670 and the support panel 550. In the illustrated example, the center cap 602 is fixedly coupled to the pillar 530 such that the center cap 602 is stationary. As disclosed below in greater detail, a wheel body 610 of the wheel 600 is configured to rotate about the center cap 602. In other examples, the center cap 602 is fixed to the wheel body 610 such that the center cap 602 rotates with the wheel body 610. The center cap 602 of the wheel 600 defines the center opening 604 through which the golf ball is capable of traveling.

In the illustrated example, the wheel assembly 500 also includes an light-emitting diode (LED) ring 551 that is configured to illuminate portions of the wheel 600 while the game is being played. In FIG. 5, the LED ring 551 is an outer LED ring coupled to an outer framework of the housing 515. Additionally or alternatively, the wheel assembly 500 may include an inner LED ring positioned around a portion of the pillar 530 between the center cap 602 and the transfer panel 670.

In some examples, the LED ring 551 is configured to emit a different color and/or pattern onto each of the cavities 620, 630, 640, 650, 660 of the wheel 600. The wheel assembly 500 includes a rotation sensor 552 that is configured to monitor rotating of the wheel 600. The processor(s) 595 of the wheel assembly 500 rotate the light emitted by the LED ring 551 based on the rate of rotation detected by the rotation sensor 552 to synchronize rotation of the different colors and/or patterns with rotation of the cavities 620, 630, 640, 650, 660 of the wheel 600. In the illustrated example, the rotation sensor 552 is fixed to the housing 515 adjacent to the wheel 600. A sticker or tag is fixed to the wheel 600 such that the rotation sensor 552 is configured to detect the tag with each rotation of the wheel 600. The rotation sensor 552 and the tag are arranged such that such that the rotation sensor 552 is stationary and no electronic wiring is run to the wheel 600.

FIG. 6 depicts the wheel assembly 500 with the transfer panel 670 also removed in order to depict additional components of the wheel assembly 500. The pillar 530 defines an opening 531 through which the golf ball is capable of traveling from the center opening 605 and to the outlet 505. The housing 515 includes a shelf 516 on which the transfer panel 670 securely rests in place. For example, the transfer panel 670 is coupled to the shelf 516 such that the transfer panel 670 is stationary. In the illustrated example, the wheel assembly 500 includes a support panel 560.

Figure 15:
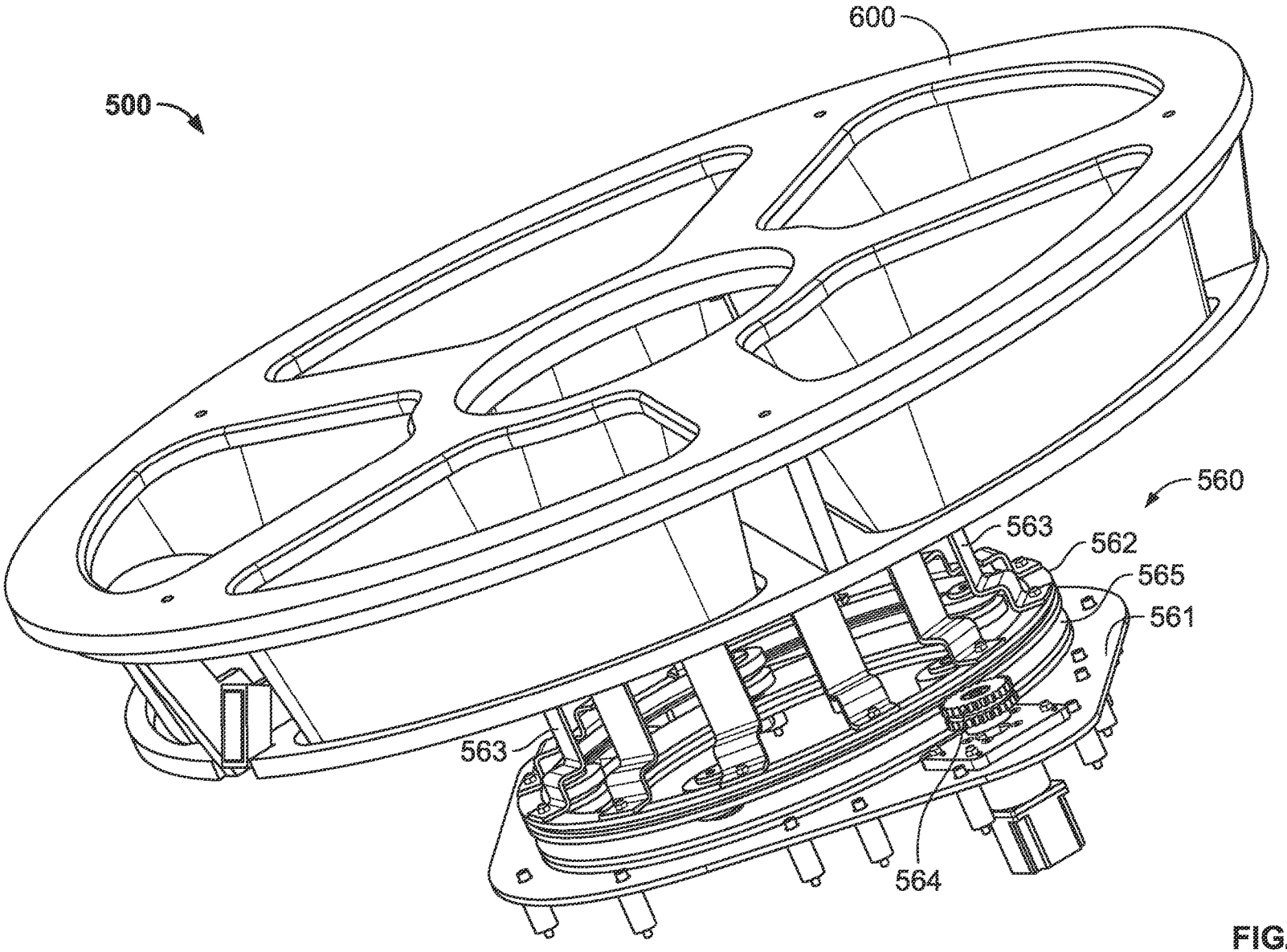
FIG. 15 further illustrates the arrangement of the wheel assembly of FIG. 5.

As most clearly shown in FIG. 15, the support panel 560 includes a fixed panel 561 and a rotating panel 562. The fixed panel 561 is securely fixed to the housing 515 and is stationary. The rotating panel 562 is mounted onto an upper surface of the fixed panel 561 and is configured to rotate relative to the fixed panel 561. The wheel assembly 500 includes a plurality of support posts 563 that extend between and couple to the rotating panel 562 and the wheel 600. The support posts 563 and the support panel 560 are configured to support the wheel 600. Additionally, the support posts 563 are connected to the wheel body 610 of the wheel 600 and are operatively connected to the motor 564. In the illustrated example, the motor 564 is securely mounted to the fixed panel 561. The motor 564 is configured to drive a belt that extends around a groove 565 of the rotating panel 562. The motor 564 drives rotation of the rotating panel 562 via the belt. Rotation of the rotating panel 562 causes the support posts 563 to rotate, which, in turn, causes the wheel body 610 of the wheel 600 to rotate. The support posts 563 are spaced apart and positioned about the pillar 530 such that the pillar 530, which is stationary, does not interfere with rotation of the support posts 563. Additionally, the electronics of the wheel assembly 500, such as wires and sensors, are securely mounted to stationary structures, such as the frame 571 of the sensor assembly 570. As a result, the wheel 600 is capable of rotating without wires causing the wiring of the electronics to become entangled.

Figure 7:
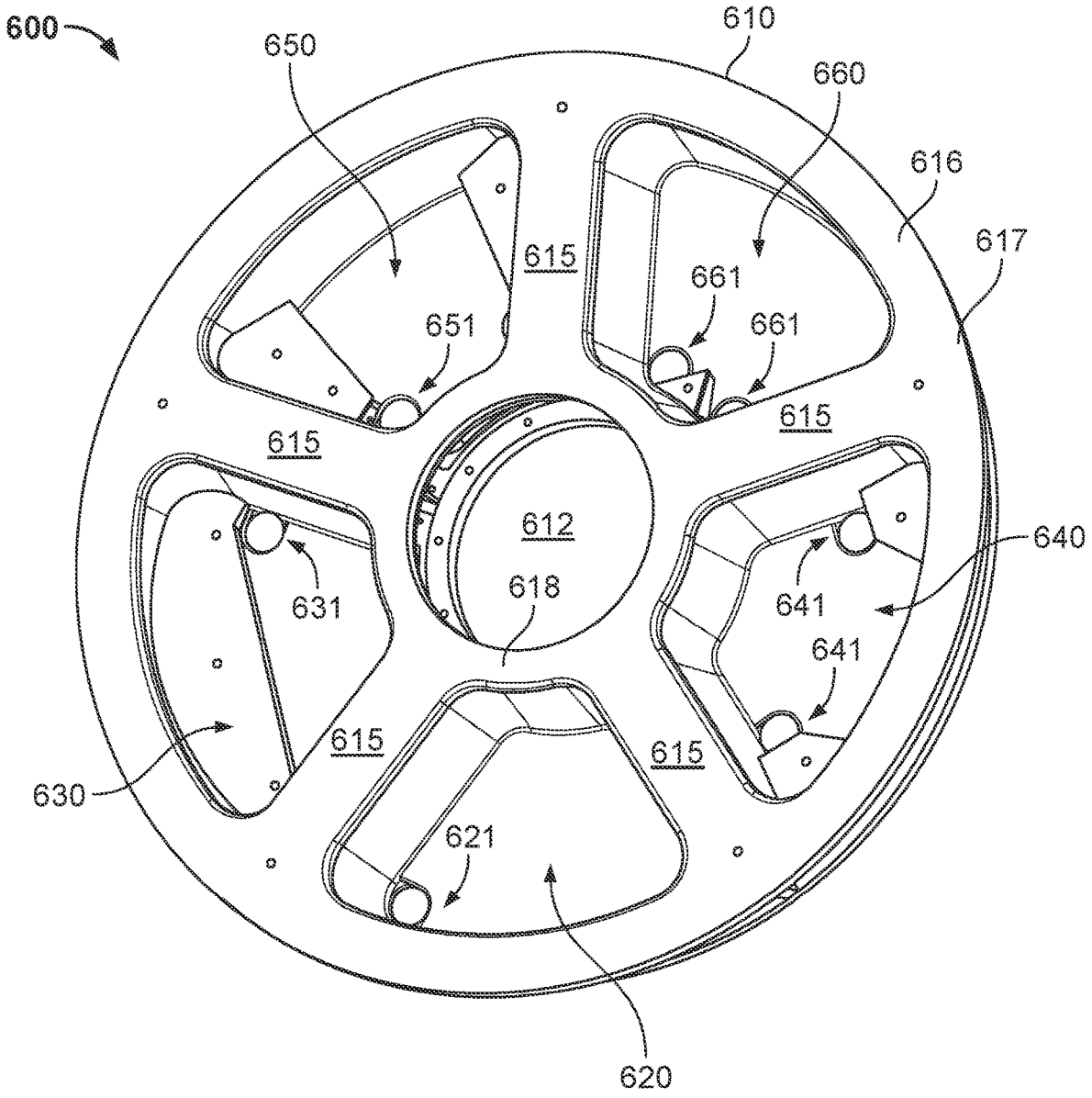
FIG. 7 illustrates a wheel body of the wheel assembly of FIG. 5.
Figure 8:
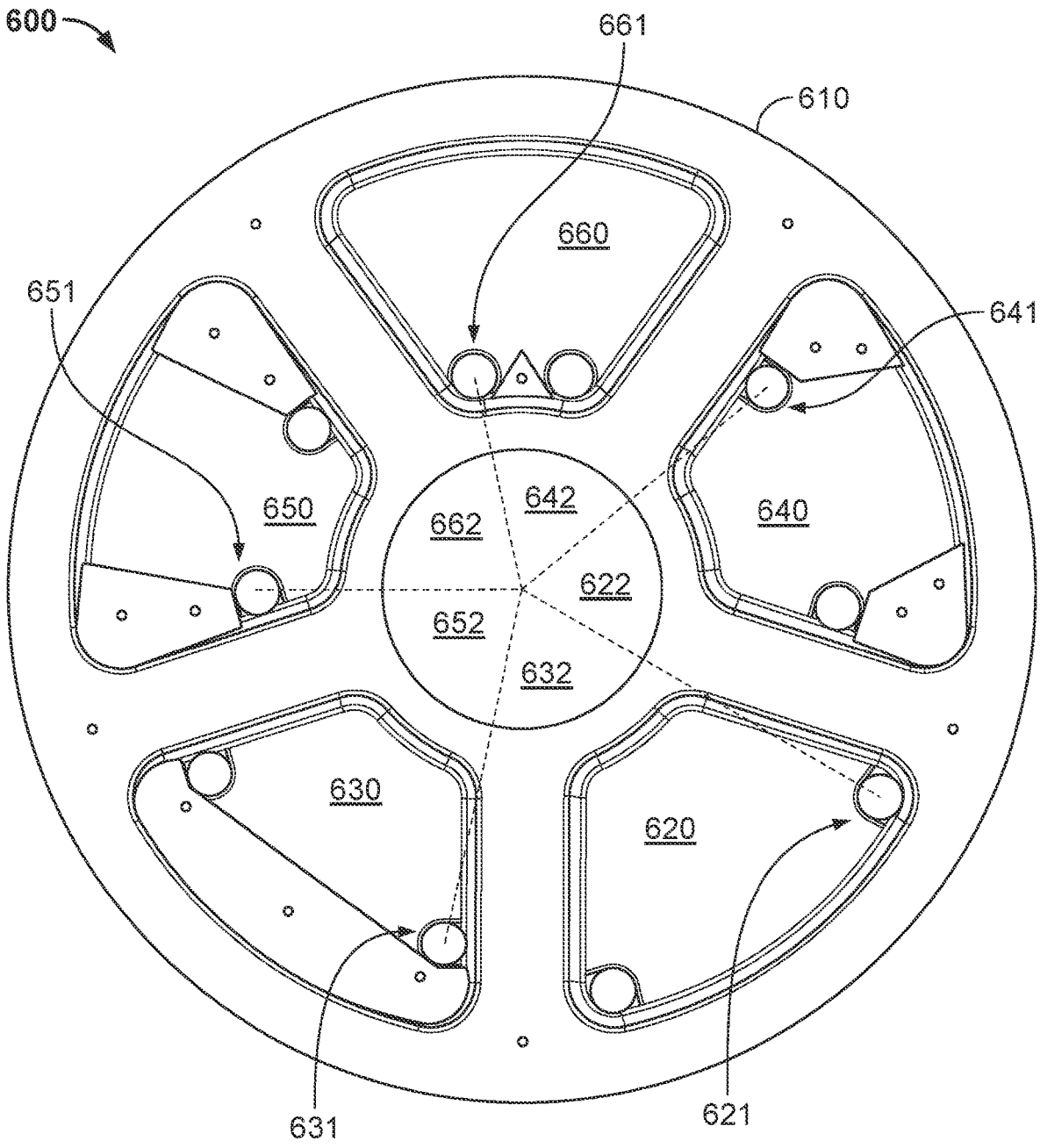
FIG. 8 further depicts the wheel body of FIG. 7.

Turning to FIGS. 7-13, features of the example wheel 600 are depicted. In particular, FIGS. 7-8 depict a wheel body 610 of the wheel 600, and FIGS. 9-13 each depict a respective one of the cavities 620, 630, 640, 650, 660. In the illustrated example, the wheel 600 defines five cavities into which the player may putt the golf ball. In other examples, the wheel 600 may include fewer or more cavities.

Figure 14:
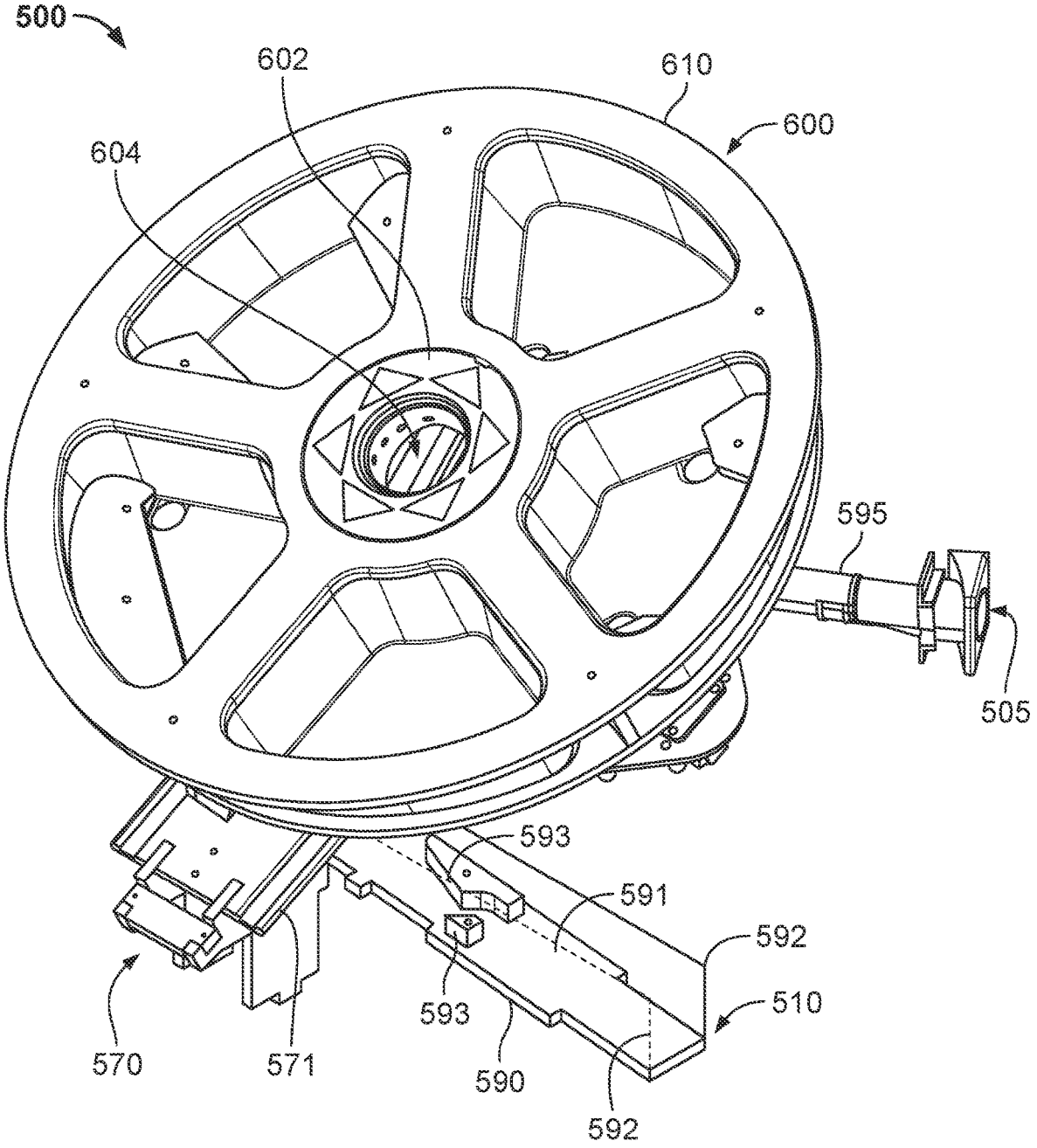
FIG. 14 illustrates an arrangement of a wheel, a sensor assembly, and channels of the wheel assembly of FIG. 5.

As illustrated in FIG. 7, the wheel body 610 of the wheel 600 defines a center aperture 612 that extends along a center axis of the wheel body 610. As shown in FIG. 14, the center cap 602 is housed within the center aperture 612 such that the center cap 602 is concentric with the wheel body 610. The center cap 602 is fixedly coupled to the pillar 530 such that the wheel body 610 rotates about center cap 602. In the illustrated example, the center opening 604 extends along the center axis of the wheel body 610 such that the center opening 604 is concentric with the center aperture 612.

Returning to FIG. 7, the cavities 620, 630, 640, 650, 660 are arranged circumferentially about the center aperture 612 in a side-by-side manner. The wheel body 610 includes radial walls 615 that extend radially between the center aperture 612 and an outer circumferential edge of the wheel body 610. The radial walls 615 are arranged in a spoke formation to separate the cavities 620, 630, 640, 650, 660 from each other. In the illustrated example, the wheel body 610 includes five of the radial walls 615 such that each of the cavities 620, 630, 640, 650, 660 is substantially-wedge shaped. Additionally, in the illustrated example, the radial walls 615 have equal widths and are equidistantly spaced apart from each other. In other examples, the radial walls 615 may have different thicknesses and/or are not equidistantly spaced apart from each other, thereby resulting in the cavities 620, 630, 640, 650, 660 being different sizes. To make the game more interesting for ambitious players, smaller cavities may be worth more points and larger cavities may be worth less points.

The wheel 600 includes the upper surface 616 along which a ball may roll into the center opening 604. In the illustrated example, the upper surface 616 is defined by the center cap 602 and an outer rim 617, an inner rim 618, and the radial walls 615 of the wheel body 610. A player may putt the golf ball into the center opening 604 of the wheel 600 by directing the golf ball to travel onto the upper surface 616, along one of the radial walls 615, and into the center opening 604. Because of the precision required for doing so, putting the golf ball into the center opening 604 may be worth more points than putting the golf ball into any of the cavities 620, 630, 640, 650, 660.

As shown in FIGS. 7-8, each of the cavities 620, 630, 640, 650, 660 includes a respective one or more openings through which the golf ball is capable of traveling. The cavity 620 includes one or more openings 621, the cavity 630 includes one or more openings 631, the cavity 640 includes one or more openings 641, the cavity 650 includes one or more openings 651, and the cavity 660 includes one or more openings 661. In the illustrated example, the opening(s) 621, 631, 641, 651, 661 (also referred to as "recessed openings" and "cavity openings") for each of the respective cavities 620, 630, 640, 650, 660 includes two holes on opposing sides of the respective cavities 620, 630, 640, 650, 660. That is, the opening(s) 621 are a set of two opposing holes, the opening(s) 631 are a set of two opposing holes, the opening(s) 641 are a set of two opposing holes, the opening(s) 651 are a set of two opposing holes, and the opening(s) 661 are a set of two opposing holes. Alternatively, each of the opening(s) 621, 631, 641, 651, 661 may be an arched slot that extends the width of the respective cavity 620, 630, 640, 650, 660.

As illustrated in FIG. 8, the opening(s) 621, 631, 641, 651, 661 are positioned at different radial distances from the center axis relative to each other. For example, the opening(s) 621 are positioned a radial distance 622 from the center axis, the opening(s) 631 are positioned a radial distance 632 from the center axis, the opening(s) 641 are positioned a radial distance 642 from the center axis, the opening(s) 651 are positioned a radial distance 652 from the center axis, and the opening(s) 661 are positioned a radial distance 662 from the center axis. The radial distance 622 of the opening(s) 621 is greater than the radial distance 632 of the opening(s) 631. The radial distance 632 of the opening(s) 631 is greater than the radial distance 642 of the opening(s) 641. The radial distance 642 of the opening(s) 641 is greater than the radial distance 652 of the opening(s) 651. The radial distance 652 of the opening(s) 651 is greater than the radial distance 652 of the opening(s) 651.

As disclosed below in greater detail with respect to FIGS. 17-18, each of the cavities 620, 630, 640, 650, 660 of the wheel 600 corresponds with a respective one of concentric rings 680, 681, 682, 683, 684 of the transfer panel 670. The opening(s) 621, 631, 641, 651, 661 of the cavities 620, 630, 640, 650, 660 are at different respective radial positions so that the opening(s) 621, 631, 641, 651, 661 of the align vertically with the respective concentric ring 680, 681, 682, 683, 684.

Figure 10:
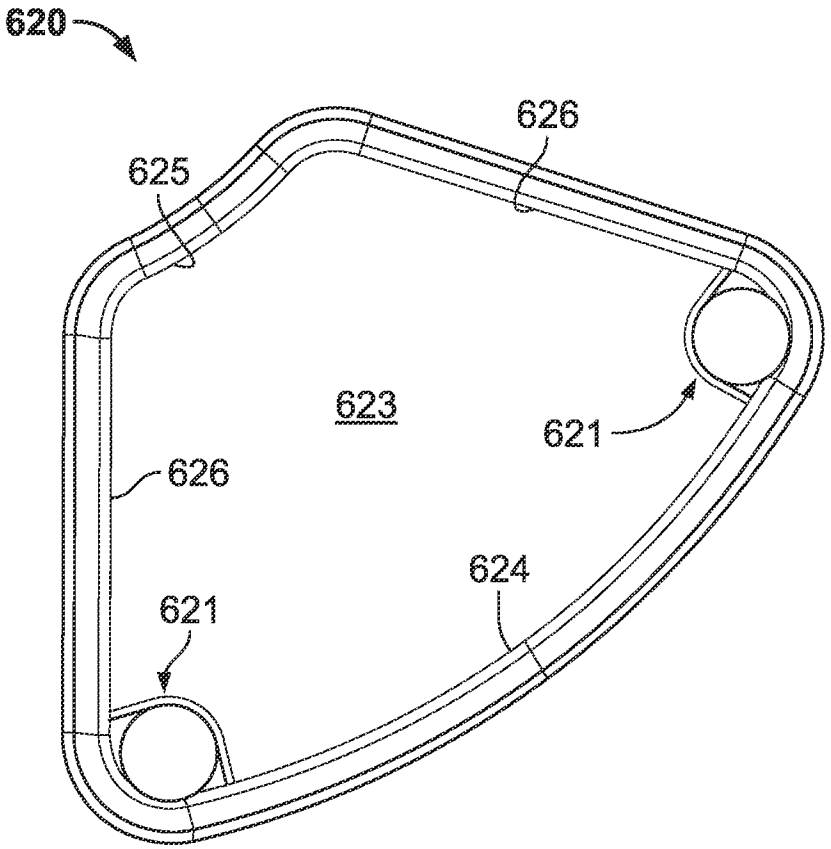
FIG. 10 depicts another recessed cavity of the wheel body of FIG. 7.
Figure 9:
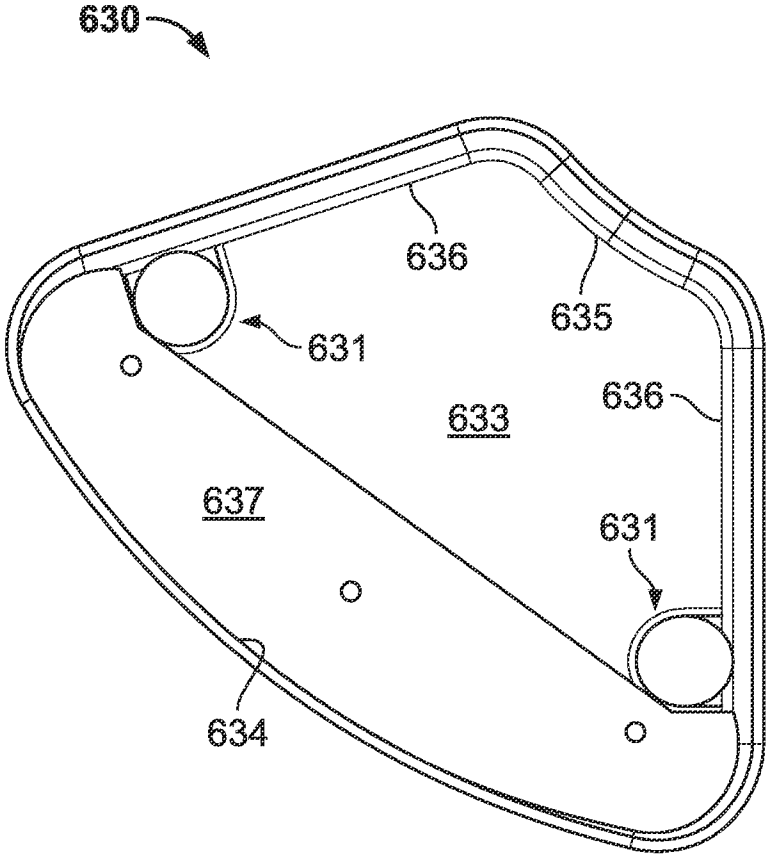
FIG. 9 depicts a recessed cavity of the wheel body of FIG. 7.
Figure 12:
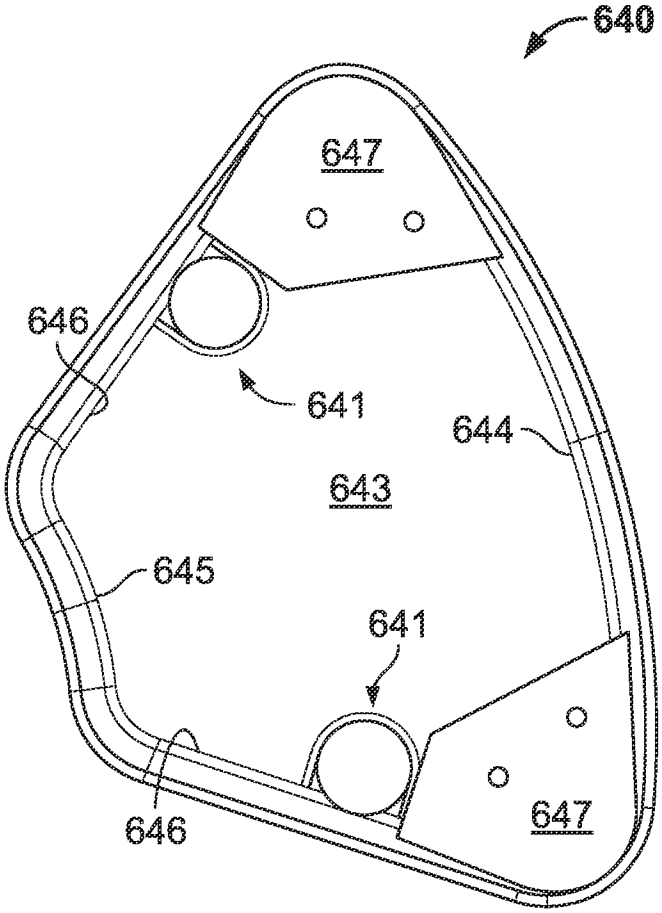
FIG. 12 depicts another recessed cavity of the wheel body of FIG. 7.
Figure 11:
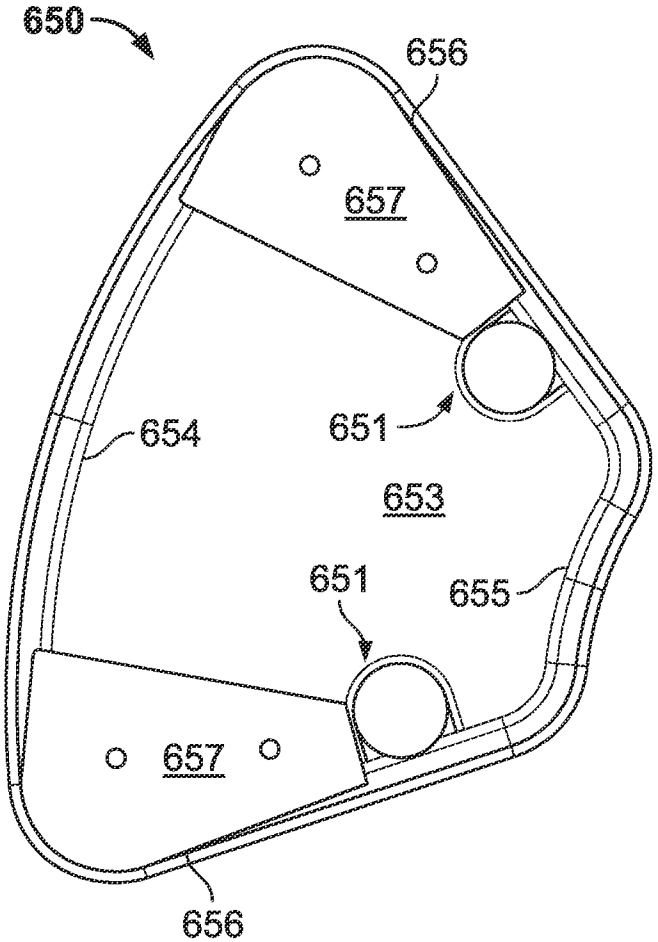
FIG. 11 depicts another recessed cavity of the wheel body of FIG. 7.
Figure 13:
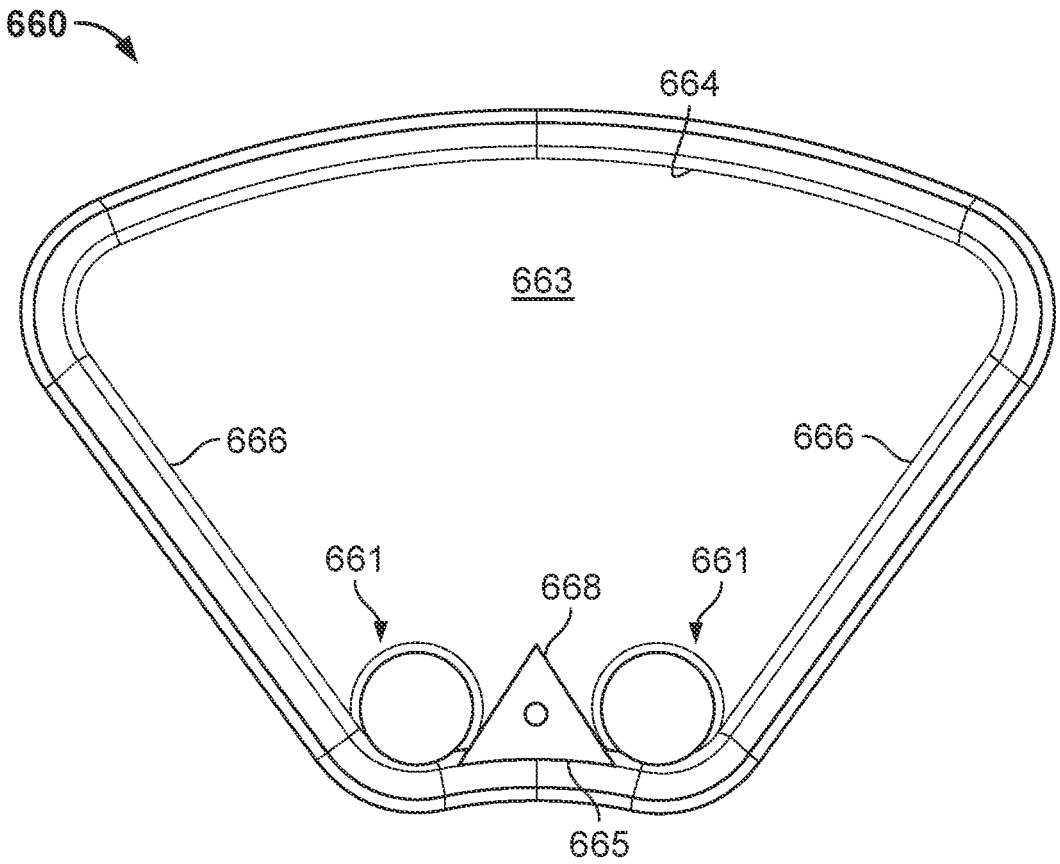
FIG. 13 depicts another recessed cavity of the wheel body of FIG. 7.

FIGS. 9-13 depict portions of the wheel 600. More specifically, FIG. 9 depicts the cavity 630, FIG. 10 depicts the cavity 620, FIG. 11 depicts the cavity 650, FIG. 12 depicts the cavity 640, and FIG. 13 depicts the cavity 660.

As shown in FIG. 9, the cavity 630 is formed or defined by a cavity surface 633, an outer-radial surface 634, an inner-radial surface 635, and opposing side surfaces 636.

The cavity surface 633 (also referred to as a "recessed surface") is parallel to the upper surface 616 of the wheel 600. The outer-radial surface 634 is defined by the outer rim 617, and the inner-radial surface 635 is defined by the inner rim 618. Each of the side surfaces 636 is defined by a respective one of the radial walls 615. The opening(s) 631 are positioned radially between and spaced apart from the outer-radial surface 634 and the inner-radial surface 635.

In the illustrated example, the wheel 600 includes a sloped insert 637 that is positioned within the cavity 630 and on a portion of the cavity surface 633. The sloped insert 637 (also referred to as a "sloped inlay") is configured to cause the golf ball to overcome the centripetal force caused by rotation of the wheel 600 and, in turn, roll into one of the opening(s) 631. That is, the sloped insert 637 is configured to guide the golf ball into one of the opening(s) 631. The sloped insert 637 of the illustrated example is positioned along the outer-radial surface 634. The sloped insert 637 includes a sloped upper surface that slopes downward from the outer-radial surface 634 and to the opening(s) 631 to guide the golf into one of the opening(s) 631.

As shown in FIG. 10, the cavity 620 is formed or defined by a cavity surface 623, an outer-radial surface 624, an inner-radial surface 625, and opposing side surfaces 626. The cavity surface 623 (also referred to as a "recessed surface") is parallel to the upper surface 616 of the wheel 600. The outer-radial surface 624 is defined by the outer rim 617, and the inner-radial surface 625 is defined by the inner rim 618. Each of the side surfaces 626 is defined by a respective one of the radial walls 615. The opening(s) 621 are positioned along the outer-radial surface 624.

As shown in FIG. 11, the cavity 650 is formed or defined by a cavity surface 653, an outer-radial surface 654, an inner-radial surface 655, and opposing side surfaces 656. The cavity surface 653 (also referred to as a "recessed surface") is parallel to the upper surface 616 of the wheel 600. The outer-radial surface 654 is defined by the outer rim 617, and the inner-radial surface 655 is defined by the inner rim 618. Each of the side surfaces 656 is defined by a respective one of the radial walls 615. The opening(s) 651 are positioned radially between and spaced apart from the outer-radial surface 654 and the inner-radial surface 655.

In the illustrated example, the wheel 600 includes a set of sloped inserts 657. The sloped inserts 657 (also referred to as a "sloped inlays") are positioned within the cavity 650 and on a portion of the cavity surface 653. Each of the sloped inserts 657 is positioned in a respective outer-radial corner formed by the outer-radial surface 654 and one of the side surfaces 656. Each of the sloped inserts 657 is configured to cause the golf ball to overcome the centripetal force caused by rotation of the wheel 600 and, in turn, roll into one of the opening(s) 651. That is, the sloped inserts 657 are configured to guide the golf ball into one of the opening(s) 651. Each of the sloped inserts 657 includes a sloped upper surface that slopes downward from the respective outer-radial corner and to one of the opening(s) 651 to guide the golf into one of the opening(s) 651.

As shown in FIG. 12, the cavity 640 is formed or defined by a cavity surface 643, an outer-radial surface 644, an inner-radial surface 645, and opposing side surfaces 646. The cavity surface 643 (also referred to as a "recessed surface") is parallel to the upper surface 616 of the wheel 600. The outer-radial surface 644 is defined by the outer rim 617, and the inner-radial surface 645 is defined by the inner rim 618. Each of the side surfaces 646 is defined by a respective one of the radial walls 615. The opening(s) 641 are positioned radially between and spaced apart from the outer-radial surface 644 and the inner-radial surface 645.

In the illustrated example, the wheel 600 includes a set of sloped inserts 647. The sloped inserts 647 (also referred to as a "sloped inlays") are positioned within the cavity 640 and on a portion of the cavity surface 643. Each of the sloped inserts 647 is positioned in a respective outer-radial corner formed by the outer-radial surface 644 and one of the side surfaces 646. Each of the sloped inserts 647 is configured to cause the golf ball to overcome the centripetal force caused by rotation of the wheel 600 and, in turn, roll into one of the opening(s) 641. That is, the sloped inserts 647 are configured to guide the golf ball into one of the opening(s) 641. Each of the sloped inserts 647 includes a sloped upper surface that slopes downward from the respective outer-radial corner and to one of the opening(s) 641 to guide the golf into one of the opening(s) 641.

As shown in FIG. 13, the cavity 660 is formed or defined by a cavity surface 663, an outer-radial surface 664, an inner-radial surface 665, and opposing side surfaces 666. The outer-radial surface 664 is defined by the outer rim 617, and the inner-radial surface 665 is defined by the inner rim 618. Each of the side surfaces 666 is defined by a respective one of the radial walls 615. The opening(s) 661 are positioned along the inner-radial surface 665.

In the illustrated example, the wheel 600 includes a sloped surface that slopes downward from the outer-radial surface 664 and toward the inner-radial surface 665. The sloped surface is configured to cause the golf ball to overcome the centripetal force caused by rotation of the wheel 600 and, in turn, roll into one of the opening(s) 661. That is, the sloped surface is configured to guide the golf ball into one of the opening(s) 661. In some examples, the cavity surface 663 (also referred to as a "recessed surface") is the sloped surface. In other examples, the cavity surface 663 is parallel to the upper surface 616 of the wheel 600, and a sloped insert (also referred to as a "sloped inlay") that defines the sloped surface is positioned over the cavity surface 663.

Additionally, in the illustrated example, the wheel 600 also includes a guide post 668 that is positioned between the opening(s) 661 along the inner-radial surface 665. The guide post 668 has a substantially-triangular shape and is configured to direct the golf ball into one of the opening(s) 661 upon approaching the inner-radial surface 665.

Figure 16:
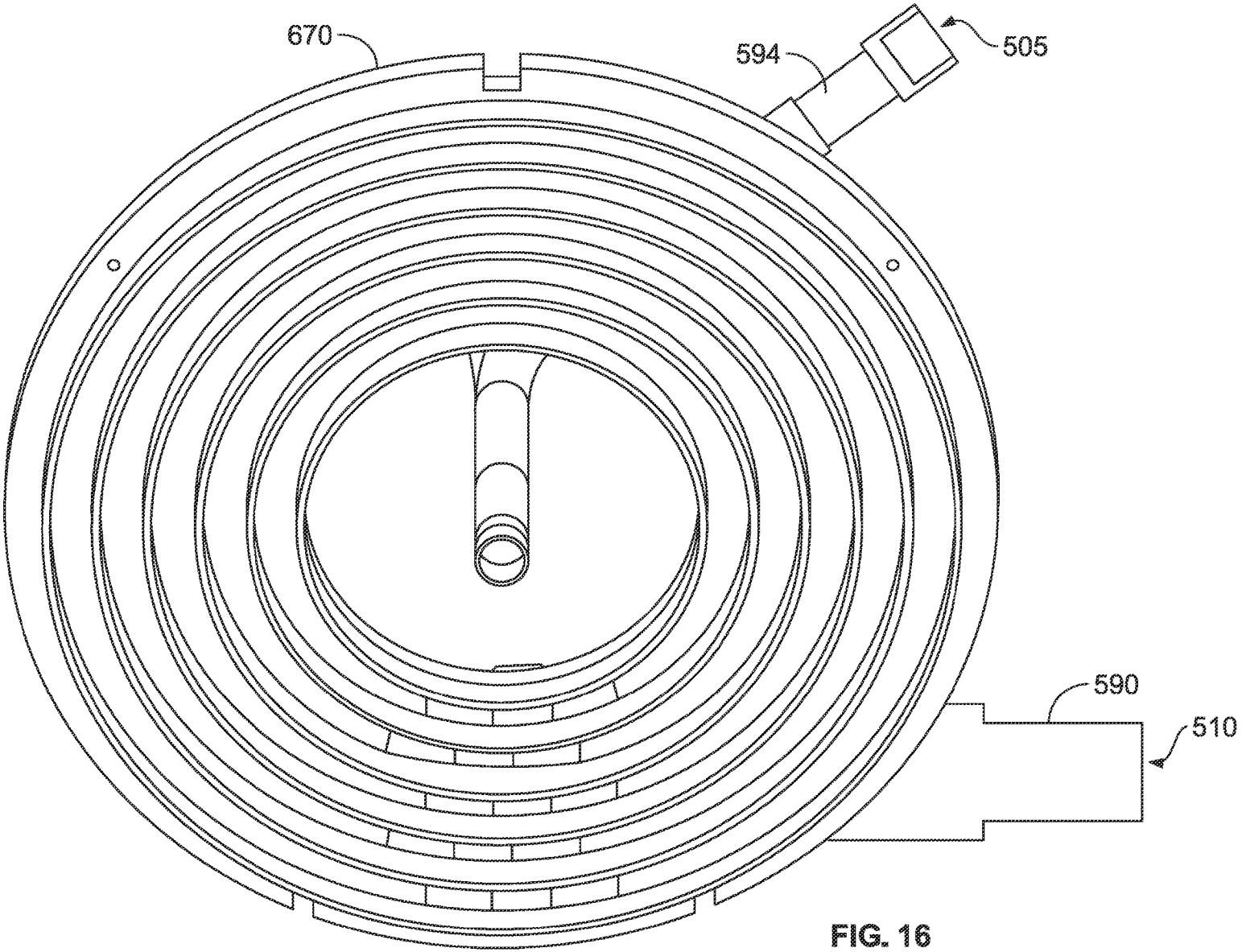
FIG. 16 illustrates an arrangement of a transfer panel and the channels of FIG. 5.
Figure 17:
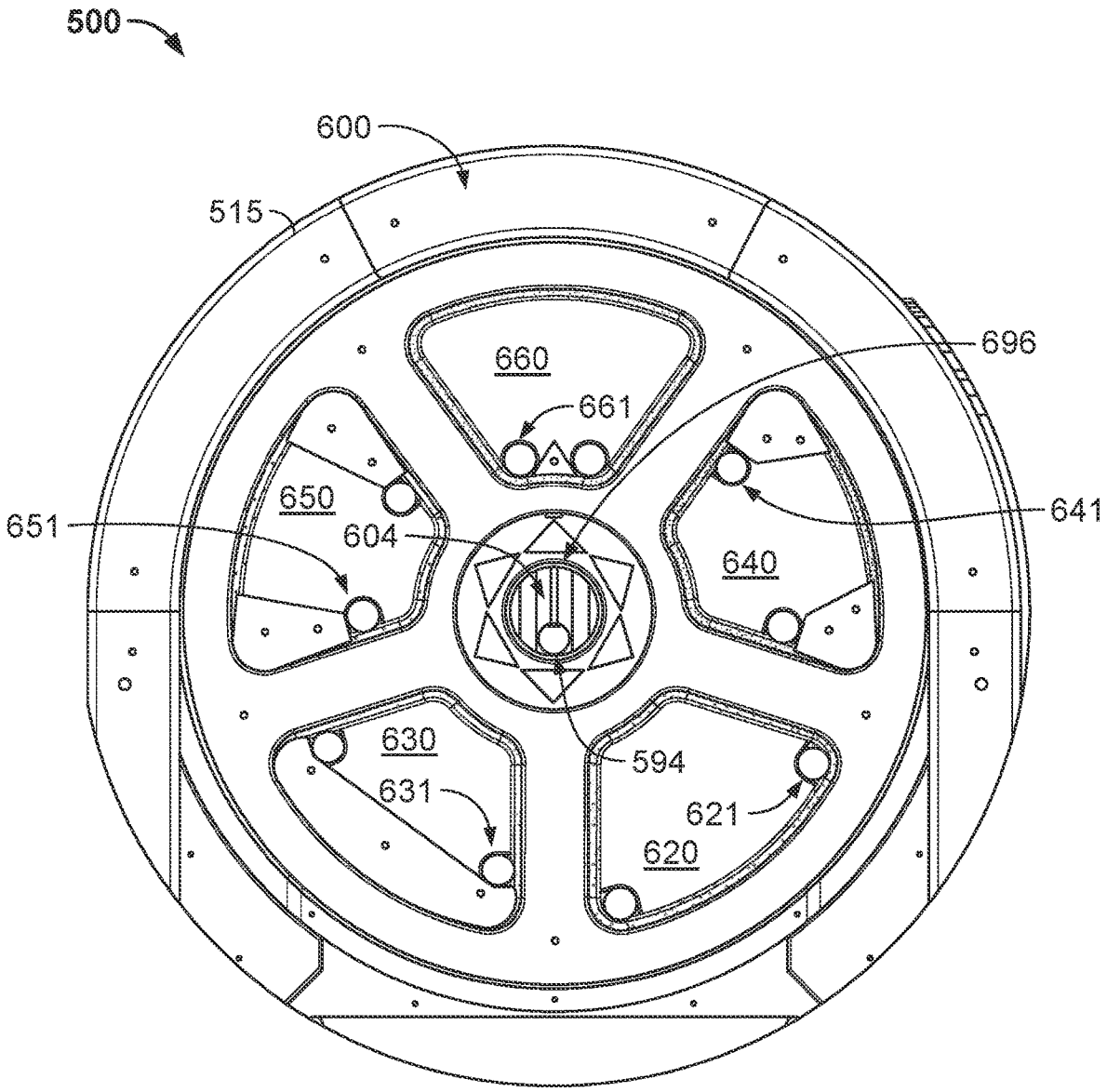
FIG. 17 further depicts the wheel of FIG. 14.
Figure 18:
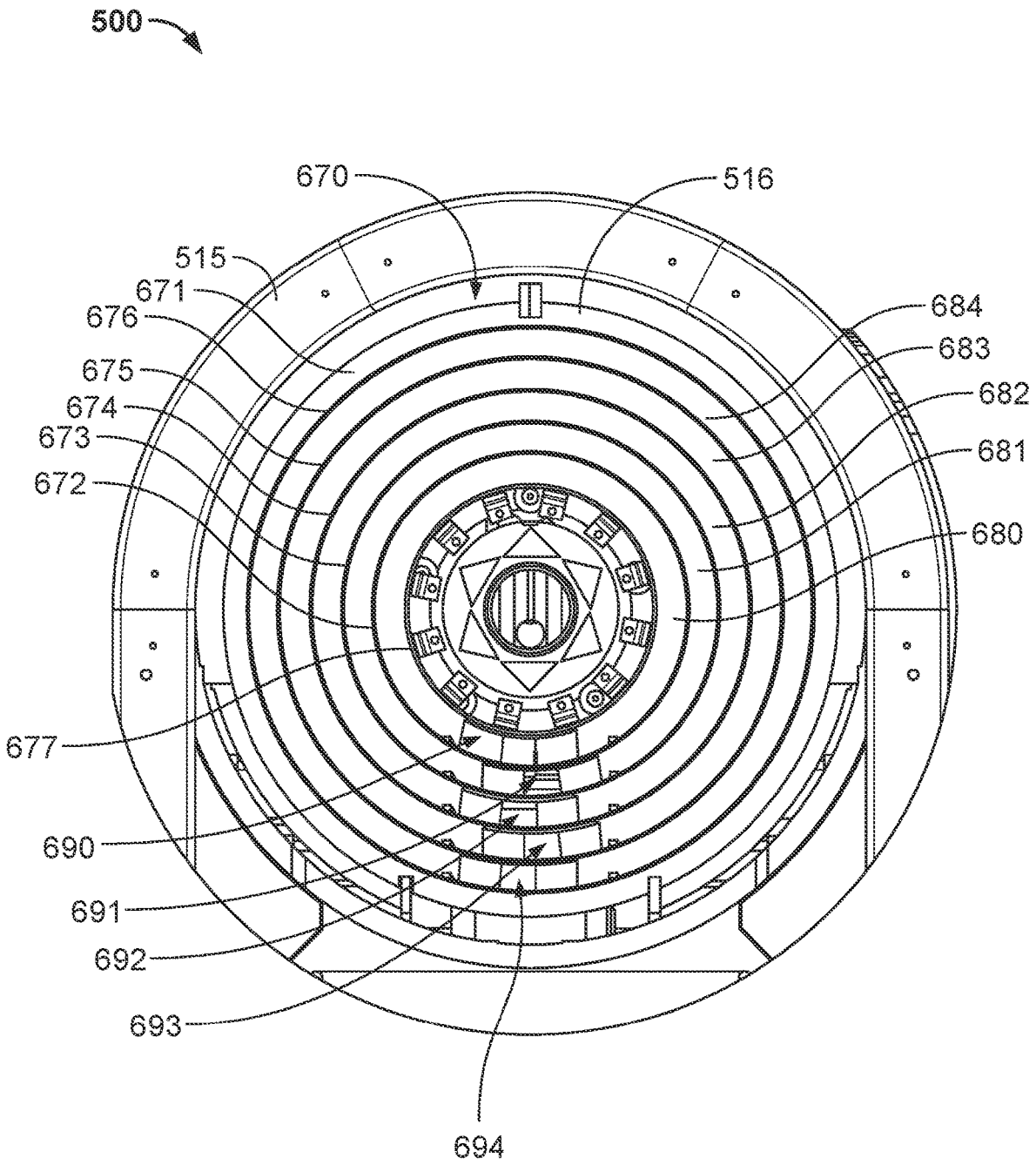
FIG. 18 further depicts the transfer panel of FIG. 14.
Figure 19:
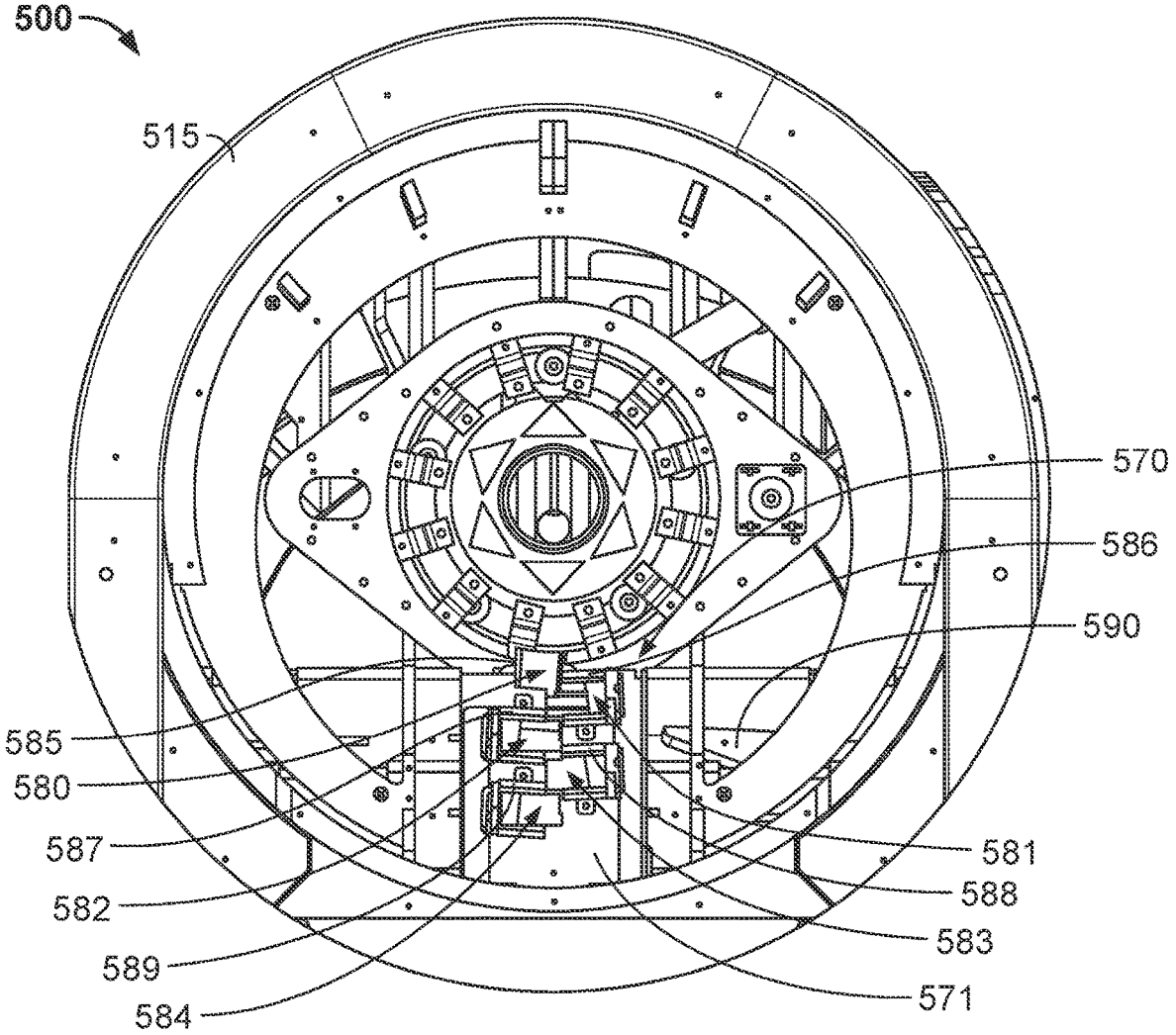
FIG. 19 further depicts the sensor assembly of FIG. 14.

FIGS. 14-19 depict components of the wheel assembly 500 that define the various potential paths for a golf ball. More specifically, the FIGS. 14-19 depict the arrangement of the wheel 600, the transfer panel 670, a sensor assembly 570, a channel 590, and another channel 594. More specifically, FIGS. 14-15 show those components of the wheel assembly 500 without the transfer panel 670 to facilitate depiction of those other components. FIG. 16 illustrates the transfer panel 670 and the channels 590, 594. FIG. 17 depicts the wheel 600, FIG. 18 depicts the transfer panel 670, and FIG. 19 depicts the sensor assembly 570 and the channel 590 in such a manner that depicts the vertical alignment of those components.

As illustrated in FIGS. 14-15 the wheel 600 is positioned in a non-vertical and non-horizontal orientation. The wheel 600 is in a non-vertical orientation to ensure that the golf ball enters the center opening 604 and/or one of the openings 621, 631, 641, 651, 661 upon being putted onto the wheel 600. The wheel 600 is in a non-horizontal orientation to enable the player to view features of the wheel 600 more easily and/or to allow gravity to help guide the golf ball into one of the openings 621, 631, 641, 651, 661.

The transfer panel 670 of the illustrated example also is positioned in a non-vertical and non-horizontal orientation. For example, transfer panel 670 is parallel to and positioned below the wheel 600. As disclosed below in greater detail with respect to FIG. 18, the transfer panel 670 is in a non-horizontal orientation to enable the player to view features of the wheel 600 more easily and/or to allow gravity to guide the golf ball in traveling out of the transfer panel 670. As disclosed below in greater detail with respect to FIG. 19, the sensor assembly 570 is positioned below the transfer panel 670, and the channel 590 is positioned below the sensor assembly 570. The wheel 600, the transfer panel 670, the sensor assembly 570, and the channel 590 are aligned in a vertical manner such that the golf ball is able to travel through one of the 621, 631, 641, 651, 661 of the wheel 600, through a respective opening 690, 691, 692, 693, 694 (FIG. 18) of the transfer panel 670, through a respective opening 580, 581, 582, 583, 584 of the sensor assembly 570 (FIG. 19), into the channel 590, out of the outlet 510 of the channel 590, and onto the hole surface 320 (FIGS. 1-2).

In the illustrated example, channel 590 includes a floor surface 591 along which the golf ball is to roll. The channel 590 also includes opposing side surfaces 592 that prevent the golf ball from rolling off a side of the floor surface 591. The channel 590 includes a check 593 located along the floor surface 591 that is configured to limit the speed of the golf ball as it rolls onto the hole surface 320 from the outlet 510. Additionally, the channel 594 is configured to transport the golf ball from the center opening 604 of the wheel 600 and out of the outlet 505 of the channel 594. In the illustrated example, the channel 594 is in the form of a tube.

FIG. 17 depicts a portion of the wheel assembly 500 and, in particular, an upper surface of the wheel 600. The wheel includes the cavities 620, 630, 640, 650, 660 with the respective opening(s) 621, 631, 641, 651, 661. Each set of opening(s) 621, 631, 641, 651, 661 is positioned at a different radial distance relative to the other opening(s) 621, 631, 641, 651, 661. Additionally, the wheel 600 defines the center opening 604 through which the golf ball is capable of traveling. In the illustrated example, a slot sensor 696 (e.g., a fork sensor) is positioned between the center opening 604 and an inlet of the channel 594. The slot sensor 696 is configured to detect when the golf ball has been putted into the center opening 604 by the player.

FIG. 18 shows the same portion of the wheel assembly 500, with the wheel 600 removed to depict the transfer panel 670. That is, transfer panel 670 is positioned below and aligns with the wheel 600. The transfer panel 670 is securely fixed to the shelf 516 of the housing 515 such that the transfer panel 670 is stationary.

The transfer panel 670 includes a floor surface 671 and a plurality of concentric walls 672, 673, 674, 675, 676, 677 extending upward from the floor surface 671 to define respective concentric rings 680, 681, 682, 683, 684. Each of the concentric rings 680, 681, 682, 683, 684 is positioned below and vertically aligned with a respective one of the opening(s) 621, 631, 641, 651, 661 to receive a golf ball that has fallen through one of the respective opening(s) 621, 631, 641, 651, 661.

As illustrated in FIG. 18, the floor surface 671 of the transfer panel 670 defines a respective opening 690, 691, 692, 693, 694 for each of the concentric rings 680, 681, 682, 683, 684. Each of the openings 690, 691, 692, 693, 694 (also referred to as "transfer openings") are positioned toward a lowest vertical point of the respective concentric ring 680, 681, 682, 683, 684 so that gravity may guide the golf ball into and through one of the openings 690, 691, 692, 693, 694 upon landing a respective one of the concentric ring 680, 681, 682, 683, 684.

FIG. 19 shows the same portion of the wheel assembly 500, with both the wheel 600 and the transfer panel 670 removed to depict the sensor assembly 570 and the channel 590. That is, the sensor assembly 570 is positioned below and aligns with the openings 690, 691, 692, 693, 694 of the transfer panel 670.

The sensor assembly 570 includes a frame 571 is securely fixed to the housing 515 such that the frame 571 is stationary. The frame 571 defines the openings 580, 581, 582, 583, 584 (also referred to as "sensor openings") through which a golf ball is capable of traveling from the transfer panel 670 and to the channel 594. The sensor assembly 570 also includes sensors 585, 586, 587, 588, 589 that are mounted to the frame 571 such that the sensors 585, 586, 587, 588, 589 are stationary.

Each of the sensors 585, 586, 587, 588, 589 (e.g., fork sensors) is positioned adjacent to a respective one of the openings 580, 581, 582, 583, 584 so that the sensors 585, 586, 587, 588, 589 are is configured to detect when a golf ball travels through the respective opening 580, 581, 582, 583, 584. Additionally, each of the openings 580, 581, 582, 583, 584 is positioned below and vertically aligned with a respective one of the openings 690, 691, 692, 693, 694 of the concentric rings 680, 681, 682, 683, 684 of the transfer panel 670.

In turn, a golf ball that is putted into the cavity 620 of the wheel 600 travels through the opening(s) 621 of the cavity 620, into the concentric ring 684, through the opening 694, through the opening 584, and onto the channel 590. By detecting when the golf ball travels through the opening 580, the sensor 589 is configured to detect when the golf ball has been putted into the cavity 620 of the wheel 600.

A golf ball that is putted into the cavity 630 of the wheel 600 travels through the opening(s) 631 of the cavity 630, into the concentric ring 683, through the opening 693, through the opening 583, and onto the channel 590. By detecting when the golf ball travels through the opening 581, the sensor 588 is configured to detect when the golf ball has been putted into the cavity 630 of the wheel 600.

A golf ball that is putted into the cavity 640 of the wheel 600 travels through the opening(s) 641 of the cavity 640, into the concentric ring 682, through the opening 692, through the opening 582, and onto the channel 590. By detecting when the golf ball travels through the opening 582, the sensor 587 is configured to detect when the golf ball has been putted into the cavity 640 of the wheel 600.

A golf ball that is putted into the cavity 650 of the wheel 600 travels through the opening(s) 651 of the cavity 650, into the concentric ring 681, through the opening 691, through the opening 581, and onto the channel 590. By detecting when the golf ball travels through the opening 581, the sensor 586 is configured to detect when the golf ball has been putted into the cavity 650 of the wheel 600.

A golf ball that is putted into the cavity 660 of the wheel 600 travels through the opening(s) 661 of the cavity 660, into the concentric ring 680, through the opening 690, through the opening 580, and onto the channel 590. By detecting when the golf ball travels through the opening 580, the sensor 585 is configured to detect when the golf ball has been putted into the cavity 660 of the wheel 600.

In the illustrated example, the sensors 585, 586, 587, 588, 589 are fixed to the frame 571 that is fixed in place, and not to the wheel 600 that rotates, so that electrical wiring for the sensors 585, 586, 587, 588, 589 does not become tangled and interfere with rotation of the wheel 600.

Figure 20:
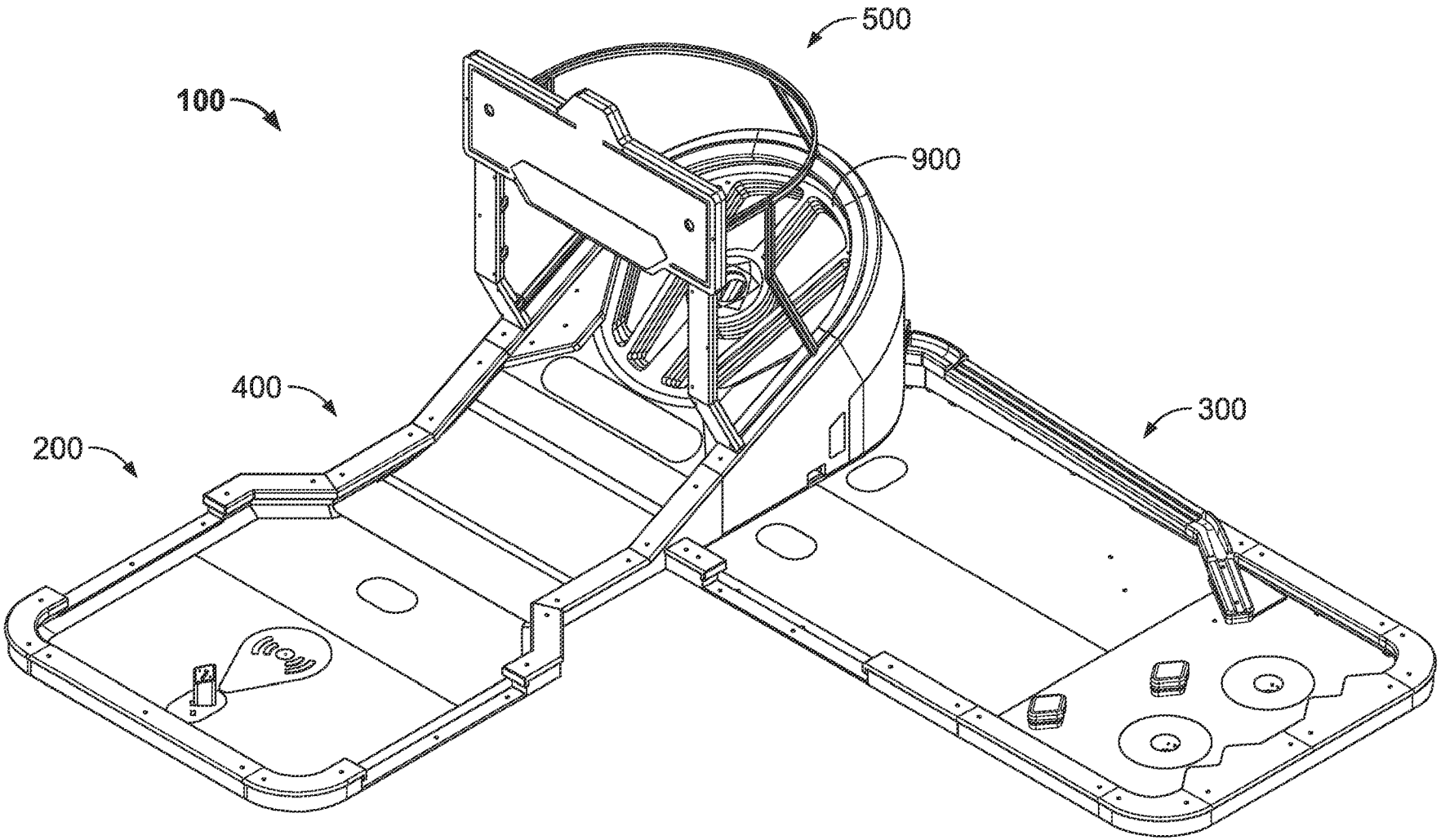
FIG. 20 illustrates the miniature golf hole of FIG. 1 with another example wheel in accordance with the teachings herein.

FIG. 20 illustrates the miniature golf hole 100 with another example wheel 900. As illustrated in FIG. 20, the miniature golf hole 100 includes the tee assembly 200, the hole assembly 300, and the ramp assembly 400. Because those components have been described in detail in connection with FIGS. 1-4, features of those components are not described in further detail below with respect to FIG. 20.

Figure 21:
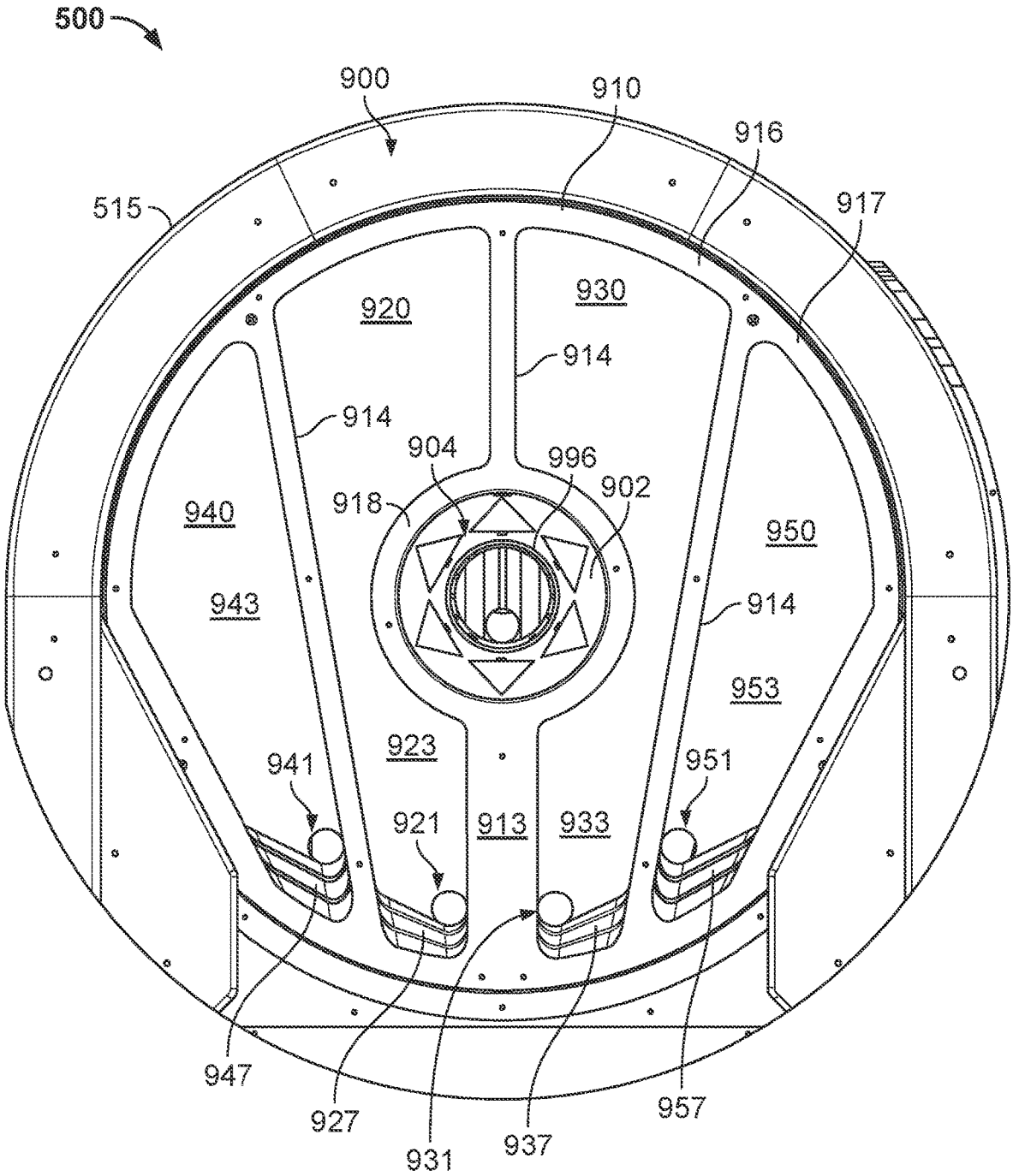
FIG. 21 further depicts the wheel of FIG. 20.
Figure 22:
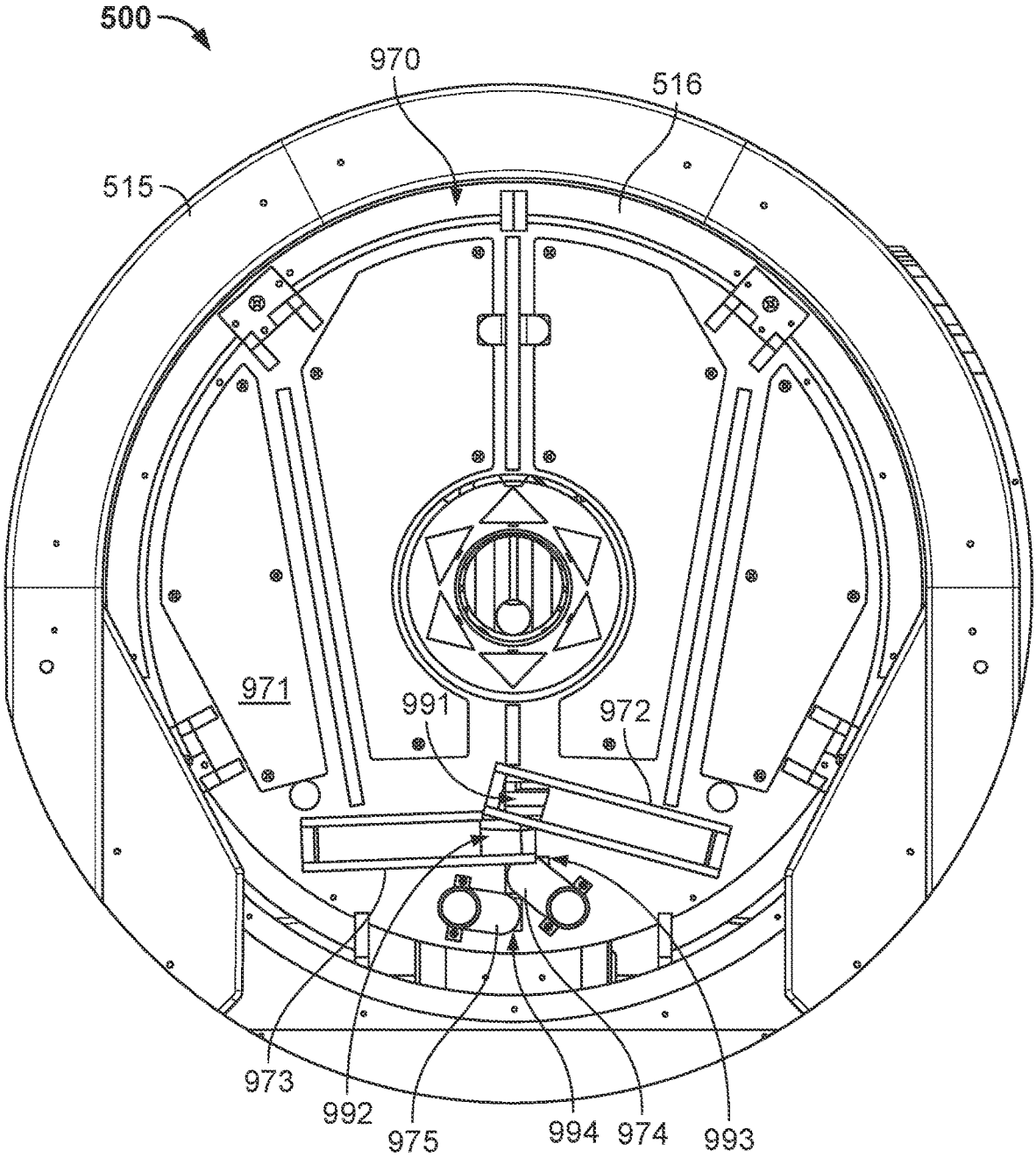
FIG. 22 illustrates another example transfer panel in accordance with the teachings herein that is used with the wheel of FIG. 20.

The miniature golf hole 100 also includes the wheel assembly 500. The wheel assembly 500 of FIGS. 20-22 includes components that are identical and/or substantially similar to those described in FIGS. 5-19, such as the outlets 505, 510; the housing 515; the shelf 516; the trip sensors 525; the pillar 530; the access panels 540, 541, 542; the sensor assembly 570; and the channels 590, 594. Unless otherwise disclosed below, components of the wheel assembly 500 include features as described with respect to FIGS. 5-19. As illustrated in FIGS. 21-22, the wheel assembly includes the example wheel 900 and another example transfer panel 970 in accordance with the teachings herein.

FIG. 21 depicts an upper surface of the wheel 900. The wheel 900 includes a center cap 902 and a wheel body 910. The wheel 900 defines a plurality of cavities 920, 930, 940, 950. In the illustrated example, the cavities 920, 930, 940, 950 are strips that extend between a front end and a rear end of the wheel 900. In the illustrated example, the wheel 900 defines four cavities into which the player may putt the golf ball. In other examples, the wheel 900 may include fewer or more cavities.

In the illustrated example, the wheel 900 is stationary and does not rotate about a center axis. For example, the wheel body 910 is fixed in place relative to the housing 515 of the wheel assembly 500. The center cap 902 is fixedly coupled to the pillar 530.

The cavities 920, 930, 940, 950 are arranged in a side-by-side manner along the wheel 900. The wheel body 910 includes dividing walls 914 that extend between the front end and the rear end of the wheel body 910. The wheel body 910 also includes a travel wall 913 that extends from the front end to the center cap 902. The dividing walls 914 are arranged to separate the cavities 920, 930, 940, 950 from each other. In the illustrated example, the wheel body 910 includes three of the dividing walls 914. Additionally, in the illustrated example, the dividing walls 914 have equal widths and are equidistantly spaced apart from each other. In other examples, the dividing walls 914 may have different thicknesses and/or are not equidistantly spaced apart from each other, thereby resulting in the cavities 920, 930, 940, 950 being different sizes.

The wheel 900 includes the upper surface 916 along which a ball may roll into a center opening 904 of the wheel 900 that is defined by the center cap 902. In the illustrated example, the upper surface 916 is defined by the center cap 902 and an outer rim 917, an inner rim 918, and the travel wall 913 of the wheel body 910. A player may putt the golf ball into the center opening 904 of the wheel 900 by directing the golf ball to travel onto the upper surface 916, along the travel wall 913, and into the center opening 904. A slot sensor 996 (e.g., a fork sensor) is positioned between the center opening 904 and an inlet of the channel 594 of the wheel assembly 500. The slot sensor 996 is configured to detect when the golf ball has been putted into the center opening 904 by the player.

Each of the cavities 920, 930, 940, 950 includes a respective one or more openings (also referred to as "recessed openings" and "cavity openings") through which the golf ball is capable of traveling. In the illustrated example, the cavity 920 includes an openings 921, the cavity 930 includes an opening 931, the cavity 940 includes an openings 941, and the cavity 950 includes an opening 951. As disclosed below in greater detail with respect to FIG. 22, each of the cavities 920, 930, 940, 950 of the wheel 900 corresponds with a respective opening 991, 992, 993, 994 of the transfer panel 970.

In the illustrated example, the cavity 920 is formed or defined by a cavity surface 923, a front surface, a rear surface, and opposing side surfaces defined by respective ones of the dividing walls 914. The cavity surface 923 (also referred to as a "recessed surface") is parallel to the upper surface 916 of the wheel 900. The opening 921 is positioned toward the front of the cavity 920. The wheel 900 also includes a sloped surface 927 (e.g., formed by a sloped insert or inlay) between the front end of the cavity 920 and the opening 921 to facilitate the ball in rolling into the opening 921.

Similarly, the cavity 930 is formed or defined by a cavity surface 933, a front surface, a rear surface, and opposing side surfaces defined by respective ones of the dividing walls 914. The cavity surface 933 (also referred to as a "recessed surface") is parallel to the upper surface 916 of the wheel 900. The opening 931 is positioned toward the front of the cavity 930. The wheel 900 also includes a sloped surface 937 (e.g., formed by a sloped insert or inlay) between the front end of the cavity 930 and the opening 931 to facilitate the ball in rolling into the opening 931.

The cavity 940 is formed or defined by a cavity surface 943, a front surface, a rear surface, and opposing side surfaces defined by respective ones of the dividing walls 914. The cavity surface 943 (also referred to as a "recessed surface") is parallel to the upper surface 916 of the wheel 900. The opening 941 is positioned toward the front of the cavity 940. The wheel 900 also includes a sloped surface 947 (e.g., formed by a sloped insert or inlay) between the front end of the cavity 940 and the opening 941 to facilitate the ball in rolling into the opening 941.

The cavity 950 is formed or defined by a cavity surface 953, a front surface, a rear surface, and opposing side surfaces defined by respective ones of the dividing walls 914. The cavity surface 953 (also referred to as a "recessed surface") is parallel to the upper surface 916 of the wheel 900. The opening 951 is positioned toward the front of the cavity 950. The wheel 900 also includes a sloped surface 957 (e.g., formed by a sloped insert or inlay) between the front end of the cavity 950 and the opening 951 to facilitate the ball in rolling into the opening 951.

FIG. 22 depicts the transfer panel 970 that is positioned below and aligns with the wheel 900. The transfer panel 970 is securely fixed to the shelf 516 of the housing 515 such that the transfer panel 970 is stationary. The transfer panel 970 includes a floor surface 971 along which a golf ball is able to roll. The transfer panel 970 defines a plurality of openings 991, 992, 993, 994 toward a front end of the floor surface 971.

In the illustrated example, the transfer panel 970 defines channels that connect the openings 921, 931, 941, 951 to the respective openings 991, 992, 993, 994 of the transfer panel 970. For example, the transfer panel 970 includes a tube 975 that define a first channel through which the golf ball is to travel from the opening 921 to the opening 994. The transfer panel 970 includes a tube 974 that define a second channel through which the golf ball is to travel from the opening 931 to the opening 993. The transfer panel 970 includes channel walls 973 that define a third channel through which the golf ball is to travel from the opening 941 to the opening 992. The transfer panel 970 includes channel walls 972 that define a fourth channel through which the golf ball is to travel from the opening 951 to the opening 991.

The sensor assembly 570 is positioned below and aligns with the transfer panel 970. A golf ball that is putted into the cavity 920 of the wheel 900 travels through the opening 921, through a channel defined by the tube 975, through the opening 994 of the transfer panel 970, through the opening 584 of the sensor assembly 570, and onto the channel 590. The sensor 589 is configured to detect when the golf ball has been putted into the cavity 920 of the wheel 900. Similarly, a golf ball that is putted into the cavity 930 of the wheel 900 travels through the opening 931, a respective channel, the openings 993, 583 and onto the channel 590. The sensor 588 is configured to detect when the golf ball has been putted into the cavity 930 of the wheel 900. A golf ball that is putted into the cavity 940 of the wheel 900 travels through the opening 941, a respective channel, the openings 992, 582 and onto the channel 590. The sensor 587 is configured to detect when the golf ball has been putted into the cavity 940 of the wheel 900. A golf ball that is putted into the cavity 950 of the wheel 900 travels through the opening 951, a respective channel, the openings 991, 581 and onto the channel 590. The sensor 586 is configured to detect when the golf ball has been putted into the cavity 950 of the wheel 900.

Figure 23:
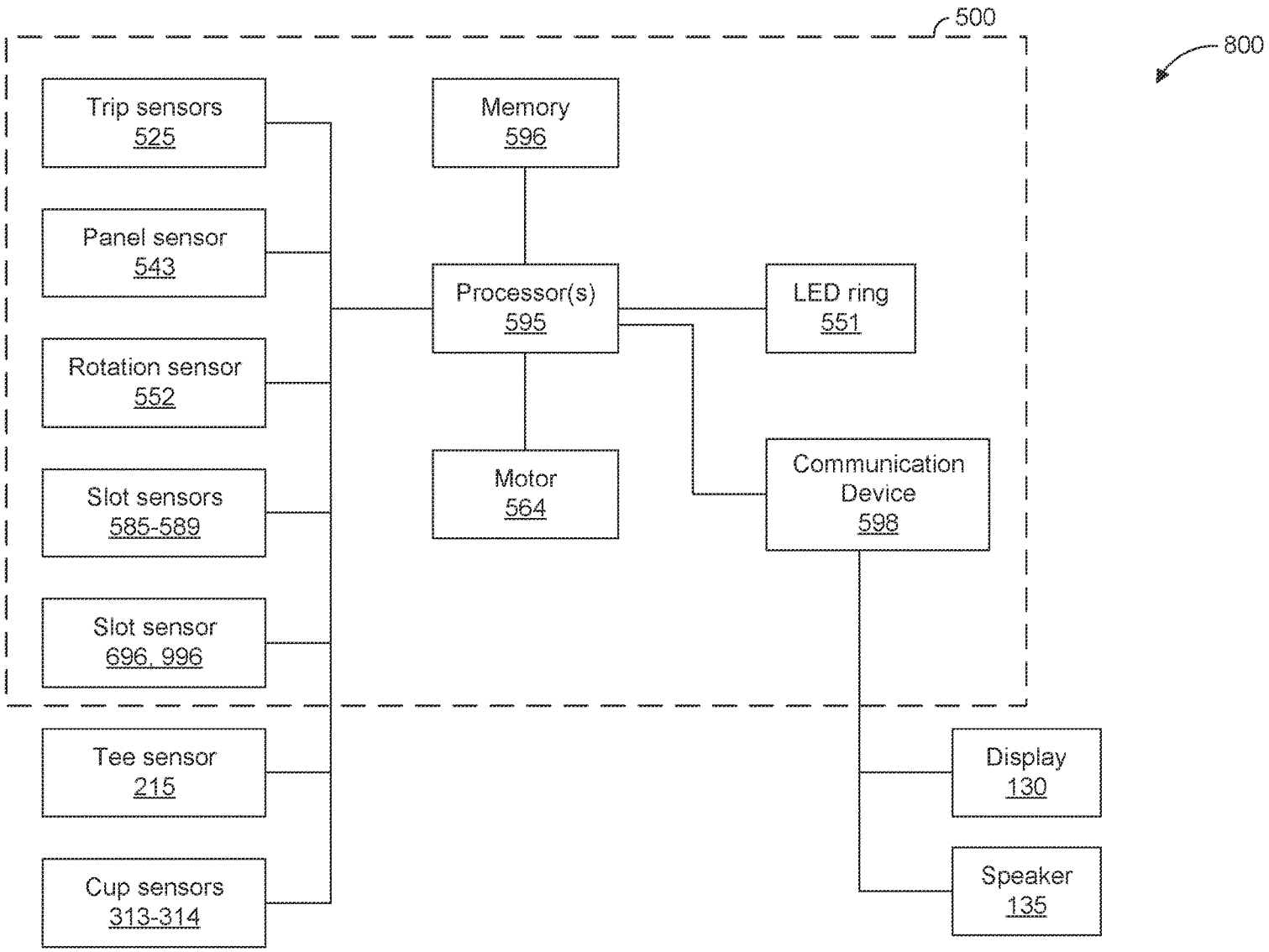
FIG. 23 is a block diagram of electronic components of the miniature golf hole of FIG. 1.

FIG. 23 depicts electronic components 800 of the miniature golf hole 100. The electronic components 800 includes one or more processor(s) 595, memory 596, the motor 564, the LED ring 551, one or more sensors, a communication device 598, one or more output devices. In the illustrated example, the sensors include the tee sensor 215; the cup sensors 313, 314; the trip sensors 525; the panel sensor 543; the LED ring 551; the rotation sensor 552; and the slot sensors 585, 586, 587, 588, 589, 696, 996. The output devices includes the display 130 and a speaker 135. In the illustrated example, the wheel assembly 500 includes the processor(s) 595; the memory 596; the motor 564; the communication device 598; the trip sensors 525; the panel sensor 543; the rotation sensor 552; and the slot sensors 585, 586, 587, 588, 589, 696, 996. In other examples, the wheel assembly 500 may include more or fewer of the electronic components 800.

The processor(s) 595 may include any processing device or set of processing devices such as, but not limited to, a microprocessor, a microcontroller-based platform, an integrated circuit, etc. The processor(s) 595 are configured to control operation of the miniature golf hole 100. Additionally, the sensors are arranged on and/or around the miniature golf hole 100 to monitor properties of the miniature golf hole 100, a golf ball being putt along the miniature golf hole 100, and/or a player putting the golf ball along the miniature golf hole 100.

For example, the processor(s) 595 are configured to instruct the motor 564 to operate and, in turn, cause the wheel 600 to rotate in response to determining that (1) none of the trip sensors 525 have detected an object and (2) the panel sensor 543 detecting that the access panel 540 is closed. The processor(s) 595 are configured to control the speed at which the motor 564 rotates the wheel 600 based on data collected by the tee sensor 215 and/or the rotational speed of the wheel 600 detected by the rotation sensor 552. The processor(s) 595 are configured to control the light emitted by the LED ring 551 based the rotational speed of the wheel 600 detected by the rotation sensor 552. The processor(s) 595 are configured to determine the information presented to the player via the display 130 and/or the speaker 135 based on data collected by one or more of the sensors. For example, the display 130 and/or the speaker 135 are configured to identify the player based on information collected by the tee sensor 215. The display 130 and/or the speaker 135 are configured to present a question and potential answers to the player based on which of the slot sensors 585, 586, 587, 588, 589, 696, 996 detected the golf ball. The processor(s) 595 are configured to assign a respective answer to each of the cups 311, 312 and subsequently assign a score to the player based on which of the cup sensors 313, 314 detect the presence of the golf ball.

The memory 596 may include volatile memory, non-volatile memory, unalterable memory, read-only memory, etc. In some examples, the memory 596 includes multiple kinds of memory, particularly volatile memory, and non-volatile memory. The memory 596 is computer readable media on which one or more sets of instructions, such as the software for operating the methods of the present disclosure, can be embedded. The instructions may embody one or more of the methods or logic as described herein. For example, the instructions reside completely, or at least partially, within any one or more of the memory 596, the computer readable medium, and/or within the processor(s) 595 during execution of the instructions.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The communication device 598 includes wired or wireless network interfaces to enable communication with external networks and/or other devices, such as the display 130 and/or the speaker 135. The external network(s) may be a public network, such as the Internet; a private network, such as an intranet; or combinations thereof, and may utilize a variety of networking protocols. The communication device 598 also includes hardware (e.g., processors, memory, storage, antenna, etc.) and software to control the wired or wireless network interfaces. For example, the communication device 598 includes hardware, software, and network interfaces for cellular network(s), such as Long Term Evolution (LTE); wireless local area networks (WLANs), such as Wi-Fi®; wireless personal area networks (WPANs), such as Bluetooth® and/or Bluetooth® Low Energy (BLE); etc.

Figure 24:
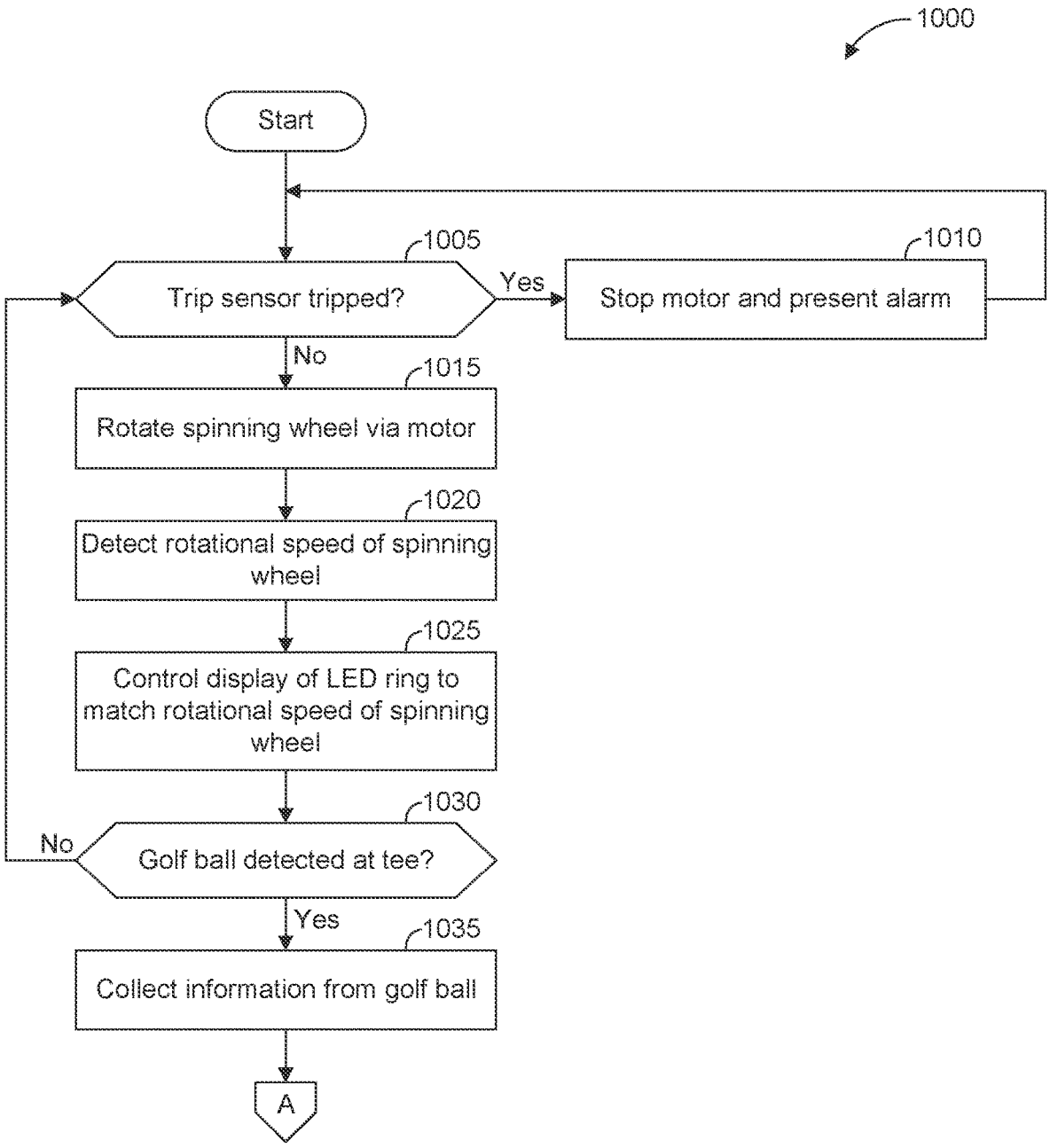
FIG. 24 is a flowchart for operating the miniature golf hole of FIG. 1 in accordance with the teachings herein.

FIG. 24 is a flowchart of an example method 1000 for operating the miniature golf hole 100. The flowchart of FIG. 24 is representative of machine readable instructions that are stored in memory (such as the memory 596 of FIG. 23) and include one or more programs which, when executed by one or more processors (such as the processor(s) 595 of FIG. 23), control operation of the miniature golf hole 100. While the example program is described with reference to the flowchart illustrated in FIG. 24, many other methods may alternatively be used. For example, the order of execution of the blocks may be rearranged, changed, eliminated, and/or combined to perform the method 1000. Further, because the method 1000 is disclosed in connection with the components of FIGS. 1-20, some functions of those components will not be described in detail below.

Initially, at block 1005, the processor(s) 595 determine whether any of the trip sensors 525 and/or the panel sensor 543 have been tripped. In response to the processor(s) 595 determining that one or more of the trip sensors 525 and/or the panel sensor 543 has been tripped, the method 1000 proceeds to block 1010 at which the processor(s) 595 send a signal to stop the motor 564 from rotating the wheel 600. Additionally, the processor(s) 595 send a signal to emit an alarm via the display 130 and/or the speaker 135. Otherwise, in response to the processor(s) 595 determining that none of the trip sensors 525 and/or the panel sensor 543 have been tripped, the method 1000 proceeds to block 1015.

At block 1015, the processor(s) 595 send a signal to instruct the motor 564 to rotate the wheel 600. At block 1020, the processor(s) 595 detect a speed at which the wheel 600 is rotating based on data collected by the rotation sensor 552. At block 1025, the processor(s) 595 cause the LED ring 551 to emit light that is in synch with the rotation of the wheel 600. That is, the LED ring 551 is controlled to emit light that matches the rotational speed of the wheel 600 such that each of the cavities 620, 630, 640, 650, 660 is lit up by a respective color and/or pattern as the wheel 600 rotates.

At block 1030, the processor(s) 595 detect, via the tee sensor 215, whether a golf ball has been placed on the tee 210. In response to the processor(s) 595 determining that no golf ball is placed on the tee 210, the method 1000 returns to block 1005. Otherwise, in response to the processor(s) 595 determining that a golf ball is on the tee 210, the method 1000 proceeds to block 1035 at which the processor(s) 595 collect information from the golf ball via the tee sensor 215 and/or other electronic devices adjacent the tee 210. Upon completion of block 1030, the method 1000 ends and a method (e.g., a method 1100 of FIG. 25, a method 1160 of FIG. 26, etc.) of gameplay begins.

Figure 25:
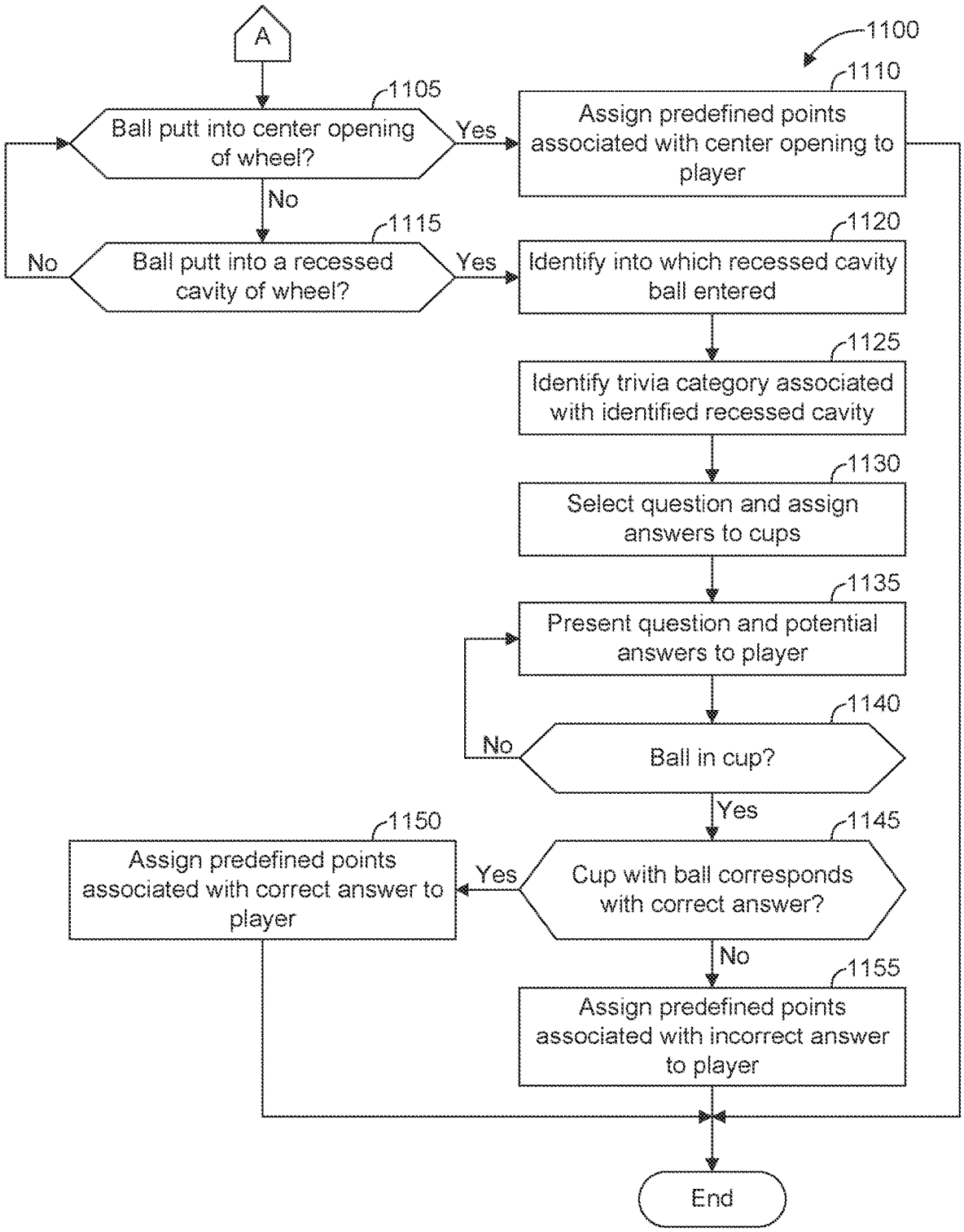
FIG. 25 is a flowchart for an example gameplay of the miniature golf hole of FIG. 1 in accordance with the teachings herein.

FIG. 25 is a flowchart of an example method 1100 for playing a game on the miniature golf hole 100. The flowchart of FIG. 25 is representative of machine readable instructions that are stored in memory (such as the memory 596 of FIG. 23) and include one or more programs which, when executed by one or more processors (such as the processor(s) 595 of FIG. 23), cause the miniature golf hole 100 to perform the gameplay. While the example program is described with reference to the flowchart illustrated in FIG. 25, many other methods may alternatively be used. For example, the order of execution of the blocks may be rearranged, changed, eliminated, and/or combined to perform the method 1100. Further, because the method 1100 is disclosed in connection with the components of FIGS. 1-23, some functions of those components will not be described in detail below.

Initially, at block 1005, the processor(s) 595 determine, via the slot sensor (e.g., the slot sensor 696 of FIG. 17, the slot sensor 996 of FIG. 21), whether the player has putted the golf ball into the center opening (e.g., the center opening 604 of FIG. 17, the center opening 904 of FIG. 21) of the wheel (e.g., the wheel 600 of FIG. 17, the wheel 900 of FIG. 21). In response to the processor(s) 595 determining that the golf ball has been putted into the center opening, the method 1100 proceeds to block 1110 at which the processor(s) 595 assigns a first predefined amount of points associated with the center opening to the player. Upon completion of block 1110, the method 1100 ends for the player. Otherwise, in response to the processor(s) 595 determining that the golf ball has not been putted into the center opening, the method 1100 proceeds to block 1115.

At block 1115, the processor(s) 595 determine whether the player has putted the golf ball into one of the cavities (e.g., the cavities 620, 630, 640, 650, 660 of FIG. 17; the cavities 920, 930, 940, 950 of FIG. 21) of the wheel. For example, the processor(s) 595 determines whether the golf ball has been putted into one of the cavities via the slot sensors 585, 586, 587, 588, 589. In response to the processor(s) 595 determining that the golf ball has not been putted into any of the cavities, the method 1100 returns to block 1105. Otherwise, in response to the processor(s) 595 determining that the golf ball has been putted into one of the cavities, the method proceeds to block 1120.

At block 1120, the processor(s) 595 identify into which of the cavities the player has putted the ball via the slot sensors 585, 586, 587, 588, 589. At block 1125, the processor(s) 595 identify a trivia category associated with the cavity into which the player has putted the ball. For example, one cavity is associated with a first category (e.g., history), another the cavity is associated with a second category (e.g., current events), another the cavity is associated with a third category (e.g., sports), another cavity is associated with a fourth category (e.g., movies), and another cavity is associated with a fifth category (e.g., music).

At block 1130, the processor(s) 595 select a question for the identified category from the memory 596. The processor(s) 595 also retrieve potential answers from the memory 596 and assign a respective answer to each of the cups 311, 312. For the example miniature golf hole 100, the processor(s) 595 assign a correct answer to one of the cups 311, 312 and an incorrect answer to the other of the cups 311, 312. At block 1135, the display 130 and/or the speaker 135 presents the question and the potential answers to the player. The display 130 and/or the speaker 135 also identifies which of the cups 311, 312 are associated with each of the answers so that the player may putt the golf ball toward the cup 311, 312 that they believe is associated with the correct answer.

At block 1140, the processor(s) 595 determine, via the cup sensors 313, 314, whether the golf ball has been putted into one of the cups 311, 312. In response to the processor(s) 595 determining that the golf ball has not yet been putted into one of the cups 311, 312, the method 1100 returns to block 1135. Otherwise, in response to the processor(s) 595 determining that the golf ball has been putted into one of the cups 311, 312, the method 1100 proceeds to block 1045.

At block 1145, the processor(s) 595 determine whether the cup 311, 312 into which the golf ball has been putted corresponds with the correct answer. In response to the processor(s) 595 determining that the cup 311, 312 corresponds with the correct answer, the method 1100 proceeds to block 1150 at which the processor(s) 595 assigns a second predefined amount of points associated with the correct answer to the player. Otherwise, in response to the processor(s) 595 determining that the cup 311, 312 does not correspond with the correct answer, the method 1100 proceeds to block 1155 at which the processor(s) 595 assigns a third predefined amount of points associated with an incorrect answer to the player. In some examples, the first predefined amount of points associated with the center opening 604 is greater than the second predefined amount of points associated with the correct answer, and the second predefined amount of points associated with the correct answer is greater than the third predefined amount of points associated with an incorrect answer. Upon completing block 1150 or block 1155, the method 1100 ends for the player.

Figure 26:
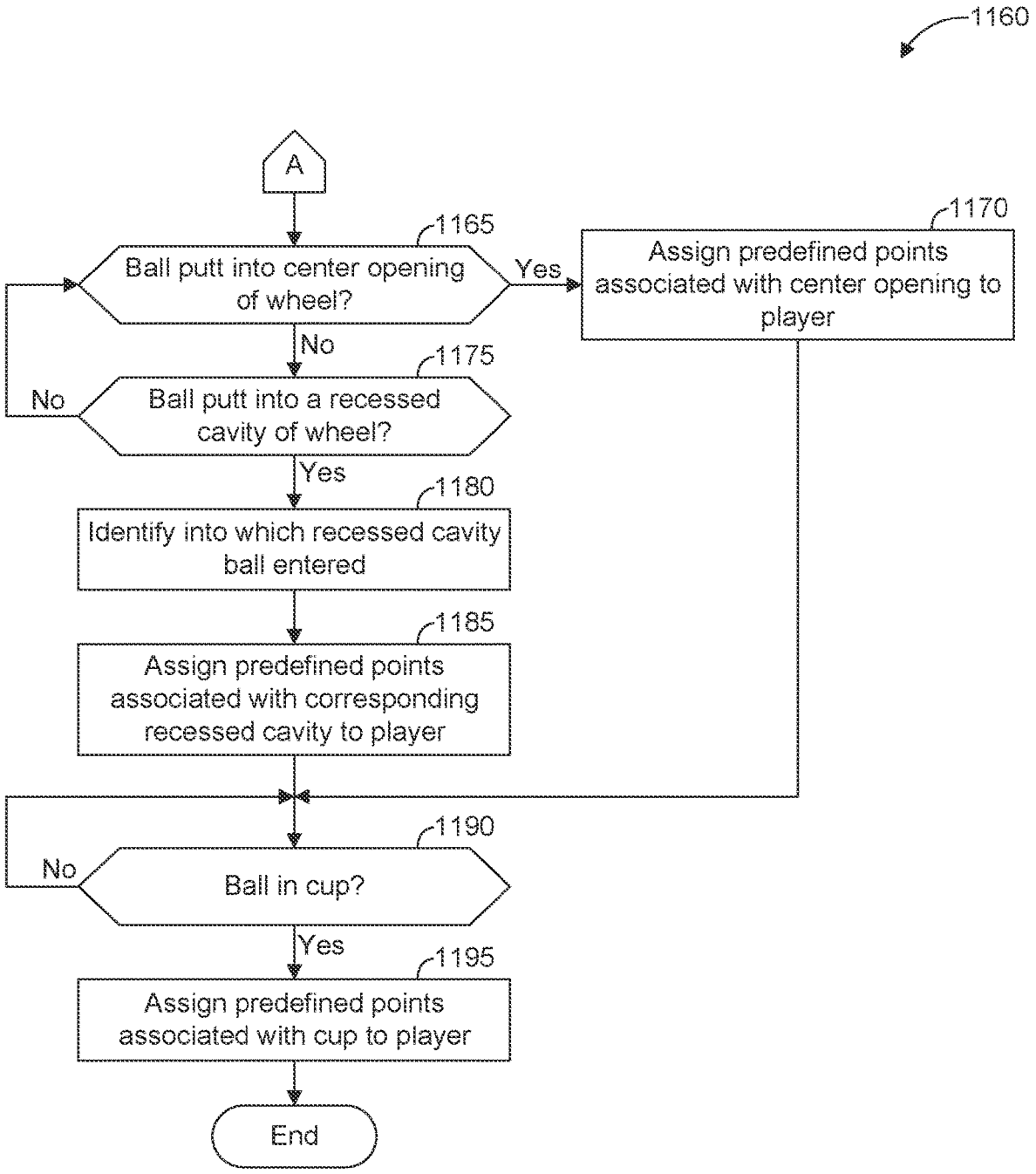
FIG. 26 is a flowchart for another example gameplay of the miniature golf hole of FIG. 1 in accordance with the teachings herein.

FIG. 26 is a flowchart of an example method 1160 for playing another game on the miniature golf hole 100. The flowchart of FIG. 26 is representative of machine readable instructions that are stored in memory (such as the memory 596 of FIG. 23) and include one or more programs which, when executed by one or more processors (such as the processor(s) 595 of FIG. 23), cause the miniature golf hole 100 to perform the gameplay. While the example program is described with reference to the flowchart illustrated in FIG. 26, many other methods may alternatively be used. For example, the order of execution of the blocks may be rearranged, changed, eliminated, and/or combined to perform the method 1160. Further, because the method 1160 is disclosed in connection with the components of FIGS. 1-23, some functions of those components will not be described in detail below.

Initially, at block 1165, the processor(s) 595 determine, via a slot sensor (e.g., the slot sensor 696 of FIG. 17, the slot sensor 996 of FIG. 21), whether the player has putted the golf ball into the center opening (e.g., the center opening 604 of FIG. 17, the center opening 904 of FIG. 21) of the wheel (e.g., the wheel 600 of FIG. 17, the wheel 900 of FIG. 21). In response to the processor(s) 595 determining that the golf ball has been putted into the center opening, the method 1160 proceeds to block 1170 at which the processor(s) 595 assigns a first predefined amount of points associated with the center opening to the player. Upon completion of block 1170, the method 1160 proceeds to block 1190. Otherwise, in response to the processor(s) 595 determining that the golf ball has not been putted into the center opening, the method 1160 proceeds to block 1175.

At block 1175, the processor(s) 595 determine whether the player has putted the golf ball into one of the cavities (e.g., the cavities 620, 630, 640, 650, 660 of FIG. 17; the cavities 920, 930, 940, 950 of FIG. 21) of the wheel. For example, the processor(s) 595 determines whether the golf ball has been putted into one of the cavities via the slot sensors 585, 586, 587, 588, 589. In response to the processor(s) 595 determining that the golf ball has not been putted into any of the cavities, the method 1160 returns to block 1165. Otherwise, in response to the processor(s) 595 determining that the golf ball has been putted into one of the cavities, the method proceeds to block 1180.

At block 1180, the processor(s) 595 identify into which of the cavities the player has putted the ball via the slot sensors 585, 586, 587, 588, 589. At block 1185, the processor(s) 595 assign a predefined amount of points, which is associated with the cavities into which the golf ball has been putted, to the player. In some examples, each of the cavities is associated with a different score to encourage the player to target one or more of the cavities. Further, in some examples, the amount of points associated with each of the cavities is less than the predefined amount of points associated with the center opening to encourage the player to target the center opening.

At block 1190, the processor(s) 595 determine, via the cup sensors 313, 314, whether the golf ball has been putted into one of the cups 311, 312. In response to the processor(s) 595 determining that the golf ball has not yet been putted into one of the cups 311, 312, the method 1160 remains at block 1190. Otherwise, in response to the processor(s) 595 determining that the golf ball has been putted into one of the cups 311, 312, the method 1160 proceeds to block 1195 at which the processor(s) 595 assigns a predefined amount of points associated with the cup 311, 312 into which the golf ball has been putted. In some examples, one of the cups 311, 312 may be worth more points than the other of the cups 311, 312. Upon completion of block 1195, the method 1160 ends for the player.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A miniature golf hole, comprising:

a tee surface on which a golf ball is set for an initial stroke;

a hole surface;

one or more putting cups positioned along the hole surface;

a spinning wheel that defines cavities arranged circumferentially about the spinning wheel in a side-by-side manner, wherein each of the cavities is partially defined by a respective cavity surface along which the golf ball is capable of traveling upon entering the respective cavity, wherein the cavity surface of each of the cavities defines one or more cavity openings through which the golf ball is capable of traveling upon entering the respective cavity, wherein the one or more cavity openings of each of the cavities are positioned at a radial distance along the spinning wheel that is different to that of the one or more cavity openings of the other of the cavities;

a ramp positioned between the tee surface and the spinning wheel to direct the golf ball onto the spinning wheel;

a transfer panel that is stationary and positioned below the spinning wheel, wherein the transfer panel includes concentric rings each of which aligns vertically with the one or more cavity openings of a respective one of the cavities to receive the golf ball from the respective cavity;

sensors configured to detect through which of the cavities the golf ball has traveled; and a first channel configured to transfer the golf ball from the transfer panel and onto the hole surface.

2. The miniature golf hole of claim 1, wherein each of the spinning wheel and the transfer panel is positioned in a non-vertical and non-horizontal orientation.

3. The miniature golf hole of claim 1, wherein the spinning wheel includes radial walls that separate the cavities from each other, and wherein the radial walls are arranged in a spoke formation such that each of the cavities is substantially wedged-shaped.

4. The miniature golf hole of claim 3, wherein each of the radial walls defines a portion of an upper surface of the spinning wheel, wherein the spinning wheel defines a center opening at a center axis of the spinning wheel, and wherein the spinning wheel is configured such that the golf ball is capable of traveling onto the upper surface, along one of the radial walls, and into the center opening.

5. The miniature golf hole of claim 4, further comprising, a second channel configured to transfer the golf ball from the center opening and into one of the one or more putting cups.

6. The miniature golf hole of claim 1, further comprising a sensor assembly that includes the sensors and is positioned below the transfer panel, wherein each of the sensors is positioned adjacent a respective one of the concentric rings of the transfer panel such that the sensors are configured to detect through which of the cavities the golf ball has traveled.

7. An assembly for a rotating surface of a miniature golf hole, the assembly comprising:

a spinning wheel that defines recessed cavities arranged circumferentially about the spinning wheel in a side-by-side manner, wherein each of the recessed cavities is partially defined by a respective recessed surface along which a golf ball is capable of traveling upon entering the respective recessed cavity, wherein the recessed surface of each of the recessed cavities defines one or more recessed openings through which the golf ball is capable of traveling upon entering the respective recessed cavity, wherein the one or more recessed openings of each of the recessed cavities are positioned at a radial distance along the spinning wheel that is different to that of the one or more recessed openings of the other of the recessed cavities;

a motor configured to drive rotation of the spinning wheel;

a transfer panel that is stationary and positioned below the spinning wheel, wherein the transfer panel includes concentric rings each of which aligns vertically with the one or more recessed openings of a respective one of the recessed cavities to receive the golf ball from the respective recessed cavity;

sensors configured to detect through which of the recessed cavities the golf ball has traveled; and a first channel configured to transfer the golf ball from the transfer panel and onto a putting surface.

8. The assembly of claim 7, wherein, for each of one or more of the recessed cavities, the spinning wheel includes one or more sloped inserts that are positioned along the recessed surface to guide the golf ball into one of the one or more recessed openings as the spinning wheel rotates.

9. The assembly of claim 7, wherein the spinning wheel includes radial walls that separate the recessed cavities from each other, and wherein the radial walls are arranged in a spoke formation such that each of the recessed cavities is substantially wedged-shaped.

10. The assembly of claim 9, wherein each of the radial walls defines a portion of an upper surface of the spinning wheel, wherein the spinning wheel defines a center opening at a center axis of the spinning wheel, and wherein the spinning wheel is configured such that the golf ball is capable of traveling onto the upper surface, along one of the radial walls, and into the center opening.

11. The assembly of claim 10, wherein the transfer panel is positioned in a non-horizontal and non-vertical orientation, and wherein each of the concentric rings defines a ring opening through which the golf ball is capable of traveling to the first channel.

12. The assembly of claim 11, further comprising a sensor assembly that includes the sensors, defines sensor openings for the golf ball, and is positioned below the transfer panel, wherein each of the sensors is positioned adjacent to a respective one of the transfer openings, and wherein the first channel is positioned below each of the sensor openings to receive the golf ball.

13. The assembly of claim 12, wherein each of the concentric rings is aligned vertically with a respective one of the recessed cavities and each of the sensor openings is aligned vertically with a respective one of the recessed cavities such that that the sensors are configured to detect through which of the recessed cavities the golf ball has traveled.

14. The assembly of claim 12, further comprising a housing to which the sensor assembly is fixed such that none of the sensors are positioned on the spinning wheel.

15. The assembly of claim 10, wherein, for each of the recessed cavities, the one or more recessed openings includes a set of holes positioned on opposing sides of the respective recessed cavity.

16. The assembly of claim 10, wherein each of the recessed cavities is defined by the respective recessed surface, a respective inner-radial surface, a respective outer-radial surface, and respective opposing side surfaces of the spinning wheel.

17. The assembly of claim 16, wherein the recessed cavities include a first recessed cavity with the one or more recessed openings positioned along the outer-radial surface of the first recessed cavity.

18. The assembly of claim 16, wherein the recessed cavities include a second recessed cavity with the one or more recessed openings positioned along the inner-radial surface of the second recessed cavity, wherein the recessed surface of the second recessed cavity is a sloped surface that slopes downward from the outer-radial surface and toward the inner-radial surface to guide the golf ball into one of the one or more recessed openings as the spinning wheel rotates.

19. The assembly of claim 16, wherein the recessed cavities include a third recessed cavity with the one or more recessed openings positioned radially between the inner-radial surface and the outer-radial surface of the third recessed cavity, wherein the recessed surface of the third recessed cavity includes a sloped insert that slopes downward from the outer-radial surface and to the one or more recessed openings to guide the golf ball into one of the one or more recessed openings as the spinning wheel rotates.

20. The assembly of claim 16, wherein the recessed cavities include a fourth recessed cavity with the one or more recessed openings positioned radially between the inner-radial surface and the outer-radial surface of the fourth recessed cavity, wherein the recessed surface of the fourth recessed cavity includes sloped inserts each of which slopes downward from a respective outer-radial corner of the recessed cavity and to a respective one of the one or more recessed openings to guide the golf ball into one of the one or more recessed openings as the spinning wheel rotates.

* * * * *